US011885323B2

(12) United States Patent
Mar et al.

(10) Patent No.: US 11,885,323 B2
(45) Date of Patent: Jan. 30, 2024

(54) LINEAR PERISTALTIC PUMPS FOR USE WITH FLUIDIC CARTRIDGES

(71) Applicant: Illumina, Inc., San Diego, CA (US)

(72) Inventors: Cameron Mar, San Diego, CA (US); Wesley A. Cox-Muranami, San Diego, CA (US); Steven Hendrix, Jamul, CA (US); Cyril Delattre, San Diego, CA (US)

(73) Assignee: ILLUMINA, INC., San Diego, CA (US)

( * ) Notice: Subject to any disclaimer, the term of this patent is extended or adjusted under 35 U.S.C. 154(b) by 161 days.

(21) Appl. No.: 16/874,934

(22) Filed: May 15, 2020

(65) Prior Publication Data

US 2020/0362846 A1 Nov. 19, 2020

Related U.S. Application Data

(60) Provisional application No. 62/849,769, filed on May 17, 2019.

(51) Int. Cl.

*F04B 43/14* (2006.01)
*F04B 43/12* (2006.01)
*F04B 43/06* (2006.01)

(52) U.S. Cl.

CPC ..... *F04B 43/1223* (2013.01); *F04B 43/06* (2013.01)

(58) Field of Classification Search

CPC ..... F04B 43/1223; F04B 43/06; F04B 43/14; F04B 45/10

(Continued)

(56) References Cited

U.S. PATENT DOCUMENTS 4,180,083 A * 12/1979 Miyaoka ..... H02J 15/003 137/101.25
4,583,920 A * 4/1986 Lindner ..... F04B 43/0733 417/317

(Continued)

FOREIGN PATENT DOCUMENTS

EP 0858812 5/2004
EP 1 905 514 A1 4/2008

(Continued)

OTHER PUBLICATIONS

Loth, et al., "Pneumatic Actuated Linear Peristaltic Micro Pump for Standalone and On-Chip Applications", Proceedings of the 13th Annual IEEE International Conference, 635-639, 2018.

(Continued)

*Primary Examiner* — Philip E Stimpert
*Assistant Examiner* — Dnyanesh G Kasture
(74) *Attorney, Agent, or Firm* — MARSHALL, GERSTEIN & BORUN LLP

(57) ABSTRACT

Linear peristaltic pumps for use with fluidic cartridges. An apparatus includes a reagent cartridge configured to be received within a cartridge receptacle of a system. The reagent cartridge includes a reagent reservoir and a body including a surface that forms depressions. Each depression has a fluid inlet and a fluid outlet and is fluidly coupled to at least one other depression. The reagent cartridge also includes a deformable material coupled to the surface of the body and includes portions. Each portion covers one of the depressions to define chambers. The portions of the deformable material are movable relative to the depressions between a first position outside of a dimensional envelope of the body and a second position within the dimensional envelope of the body.

25 Claims, 19 Drawing Sheets

(58) Field of Classification Search
USPC ..... 417/395, 413.1, 413.2, 413.3
See application file for complete search history.

(56) References Cited

U.S. PATENT DOCUMENTS

| | | | | |
|---|---|---|---|---|
| 5,593,290 | A * | 1/1997 | Greisch | F04B 43/021 417/478 |
| 5,924,852 | A | 7/1999 | Moubayed et al. | |
| 6,776,591 | B1 * | 8/2004 | Rinninger | F04B 43/028 92/99 |
| 7,056,475 | B2 | 6/2006 | Lum et al. | |
| 8,366,420 | B1 | 2/2013 | Geschwender | |
| 9,410,977 | B2 | 8/2016 | Stone et al. | |
| 2005/0092662 | A1 | 5/2005 | Gilbert et al. | |
| 2005/0169816 | A1 * | 8/2005 | Kirshner | C40B 60/06 422/130 |
| 2008/0044309 | A1 * | 2/2008 | Yamashita | G01N 30/08 422/52 |
| 2008/0050256 | A1 * | 2/2008 | Ogawa | F04B 43/021 417/560 |
| 2008/0217260 | A1 * | 9/2008 | Papageorge | C01B 7/14 210/753 |
| 2010/0047099 | A1 * | 2/2010 | Miyazaki | F04B 43/082 417/477.6 |
| 2011/0186143 | A1 * | 8/2011 | Miyazaki | F04B 43/082 137/67 |
| 2012/0167673 | A1 * | 7/2012 | Farjam | B01L 3/50273 73/64.56 |
| 2012/0198921 | A1 | 8/2012 | Lundgreen et al. | |
| 2015/0045234 | A1 * | 2/2015 | Stone | B01L 3/527 435/6.1 |
| 2017/0144155 | A1 * | 5/2017 | Bohm | B01L 3/502738 |
| 2018/0188279 | A1 * | 7/2018 | Whitacre | B01F 35/53 |

FOREIGN PATENT DOCUMENTS

| | | | |
|---|---|---|---|
| EP | 2 733 356 | A1 | 5/2014 |
| EP | 2733356 | | 5/2014 |
| WO | 1984/000691 | | 3/1984 |
| WO | WO-2005/111423 | A1 | 11/2005 |
| WO | 2015/073999 | | 5/2015 |
| WO | 2015/179098 | | 11/2015 |
| WO | WO-2015/179098 | A1 | 11/2015 |
| WO | 2016/205428 | | 12/2016 |
| WO | WO-2016/205428 | A1 | 12/2016 |

OTHER PUBLICATIONS

Neto, et al., "Linear Peristaltic Pump Driven by Three Magnetic Actuators: Simulation and Experimental Results", IEEE International Instrumentation and Measurement Technology Conference, 2011.

Pilarski, et al., "An Adaptable Microvalving System for On-Chip Polymerase Chain Reactions", Journal of Immunological Methods, vol. 305, 48-58, 2015.

Zhao, et al., "A Controllable and Integrated Pump-Enabled Microfluidic Chip and its Application in Droplets Generating", Scientific Reports 7.1, 1-8, 2017.

* cited by examiner

LINEAR PERISTALTIC PUMPS FOR USE WITH FLUIDIC CARTRIDGES

RELATED APPLICATION

This application claims the benefit of and priority to U.S. Provisional Patent Application No. 62/849,769, filed May 17, 2019, the content of which is incorporated by reference herein in its entirety and for all purposes.

BACKGROUND

Fluidic cartridges carrying reagents and a flow cell are sometimes used in connection with fluidic systems. The fluidic cartridges include fluidic lines through which the reagents flow. To draw the reagent through the fluidic lines, a syringe pump may be used.

SUMMARY

In accordance with a first example, an apparatus includes or comprises a reagent cartridge that is configured to be received within a cartridge receptacle of a system. The reagent cartridge includes or comprises a reagent reservoir and a body that includes or comprises a surface that forms depressions. Each depression has or comprises a fluid inlet and a fluid outlet and is fluidly coupled to at least one other depression. The reagent cartridge also includes or comprises a deformable material that is coupled to the surface of the body and includes or comprises portions. Each portion covers one of the depressions to define chambers. The portions of the deformable material are movable relative to the depressions between a first position outside of a dimensional envelope of the body and a second position within the dimensional envelope of the body.

In accordance with a second example, an apparatus includes or comprises a system that includes or comprises a cartridge receptacle, a pump drive assembly, and a controller coupled to the pump drive assembly. The apparatus includes or comprises a fluidic cartridge that is receivable within the cartridge receptacle and carries a flow cell. The fluidic cartridge includes or comprises a reservoir and chambers that are defined by a body of the fluidic cartridge. The fluidic cartridge also includes or comprises a deformable material that covers the chambers and includes fluidic lines that fluidly couple the reservoir, the flow cell, and the chambers. The pump drive assembly, the chambers, and the deformable material form a linear peristaltic pump. The controller is adapted to cause the pump drive assembly to interface with the deformable material to cause the linear peristaltic pump to pump fluid through one or more of the fluidics lines.

In accordance with a third example, an apparatus includes or comprises a body having a mating surface and defines chambers. The chambers are fluidly coupled and have inlets and outlets. Each inlet is vertically offset relative to a corresponding outlet. The apparatus includes or comprises a deformable material that is coupled to the mating surface and cover the chambers. The deformable material and the chambers form a linear peristaltic pump. The deformable material that covers each of the chambers is movable between a first position and a second position. In the first position, the deformable material sealingly engaging the inlet of the corresponding chamber. In the second position, the deformable material sealingly engaging the outlet of the corresponding chamber.

In accordance with a fourth example, an apparatus includes or comprises a reagent cartridge that includes or comprises a reagent reservoir, a body defining chambers, and fluidics lines. Each chamber has a fluid inlet and a fluid outlet and is fluidly coupled to at least one other chamber via one or more of the fluidic lines. Each inlet is vertically offset relative to a corresponding outlet. The reagent reservoir is coupled to the body and to one or more of the fluidic lines. The apparatus also includes a deformable material that is coupled to the body and that covers the chambers. The deformable material is movable to pump fluid relative to the chambers. The deformable material is movable between a first position sealingly engaging the inlet of a corresponding chamber and a second position sealingly engaging the outlet of a corresponding chamber.

In accordance with a fifth example, a method includes or comprises actuating one or more portions of a deformable material of a fluidic cartridge between a first position and a second position. Each portion covers a depression to define a chamber and forms a portion of a linear peristaltic pump. The method includes generating a pulsatile flow through the fluidic cartridge in response to the actuation.

In further accordance with the foregoing first, second, third, fourth, and/or fifth examples, an apparatus and/or method may further include or comprise any one or more of the following:

In accordance with one example, the reagent cartridge carries a flow cell and the chambers are positioned downstream of the flow cell.

In accordance with another example, the reagent cartridge carries a flow cell and the chambers are positioned upstream of the flow cell.

In accordance with another example, the inlets are offset relative to respective ones of the outlets.

In accordance with another example, the surface of the body includes or comprises a mating surface to which the deformable material is coupled and the depressions are concave and include or comprise apexes. The inlets are positioned adjacent to the mating surface on a first side of the respective chambers and the outlets are positioned adjacent the apexes of the chambers on a second side of the respective chambers.

In accordance with another example, the deformable material includes or comprises a first surface and a second surface, the portions of the deformable material include or comprise first portions, and the surface of the body includes or comprises a mating surface. The first surface includes or comprises the first portions and second portions. The second portions of the first surface are coupled to the mating surface of the body. The first portions of the first surface and the second portions of the first surface are substantially coplanar.

In accordance with another example, the first surface and the second surface are substantially parallel relative to one another.

In accordance with another example, the deformable material includes or comprises female portions that are defined by the second surface of the deformable material and are positioned adjacent to the second portion of the first surface of the deformable material.

In accordance with another example, the chambers are coupled via a fluidic line having or comprising a first fluidic-line portion and a second fluidic-line portion. The first fluidic-line portion is coupled to the outlet of a first one of the chambers and extends toward the mating surface and the second fluidic-line portion is coupled to the first fluidic-line portion and to the inlet of a second one of the chambers.

In accordance with another example, the deformable material includes or comprises concave portions that cover the respective depressions.

In accordance with another example, the concave portions include or comprise membrane switches.

In accordance with another example, the deformable material includes or comprises a first surface and a second surface. The first surface is coupled to the body. The second surface includes or comprises female portions positioned adjacent to the depressions of the body.

In accordance with another example, the controller is adapted to cause the pump drive assembly to interface with the deformable material to cause the linear peristaltic pump to create a pulsatile flow of fluid through the one or more of the fluidics lines.

In accordance with another example, the controller is adapted to cause the pump drive assembly to interface with the deformable material that covers a first one of the chambers but not to interface with the deformable material that covers a second one of the chambers.

In accordance with another example, the pump drive assembly includes or comprises a guide includes or comprises guide bores, rods disposed within the respective guide bores, and an actuator adapted to selectively actuate the rods between a retracted position and an extended position. The rods includes or comprises distal ends that are adapted to depress the deformable material of the linear peristaltic pump in the extended position.

In accordance with another example, the rods include or comprise cam followers. The apparatus also includes or comprises springs disposed within the respective ones of the guide bores to urge the cam followers toward the retracted position. The actuator includes or comprises a cam shaft and a motor adapted to rotate the cam shaft. The cam shaft is adapted to interface with the cam followers to actuate the cam followers.

In accordance with another example, the actuator includes or comprises rocker arms, a first cam shaft including first lobes, and a second cam shaft including second lobes. A first portion of each of the rocker arms is pivotably coupled to one of the rods. A second portion of the rocker arms engages the second lobes of the second cam shaft. The second cam shaft is rotatable to change a relative location between the rocker arms and the first cam shaft.

In accordance with another example, the actuator includes or comprises piezoelectric actuators. The piezoelectric actuators are coupled to the respective rods to actuate the rods.

In accordance with another example, the actuator includes or comprises a pneumatic actuator. The pneumatic actuator includes or comprises single-acting cylinders having or comprising a spring return. The cylinders are coupled to respective ones of the rods.

In accordance with another example, the deformable material includes or comprises female portions that cover the chambers and the distal ends of the rods include or comprise male portions. The male portions are to be received within respective ones of the female portions to couple the rods to the deformable material.

In accordance with another example, the deformable material includes or comprises female portions that cover the chambers and receive first magnets. The distal ends of the rods carry second magnets. The first magnets are attracted to respective ones of the second magnets to couple the rods to the deformable material.

In accordance with another example, the fluidic cartridge includes or comprises a manifold. The manifold includes or comprises apertures that are coupled adjacent respective ones of the chambers. The pump drive assembly includes or comprises a pressure source. The pressure source is adapted to be fluidly coupled to the apertures of the manifold to change a pressure within the apertures and to cause the linear peristaltic pump to pump fluid from the reservoir to the flow cell.

In accordance with another example, the manifold includes or comprises valves to control fluid flow through the respective apertures and the system includes or comprises a valve drive assembly. The controller is coupled to the valve drive assembly. The controller is adapted to cause the valve drive assembly to interface with the valves to cause the valves to selectively fluidly couple the apertures and the pressure source.

In accordance with another example, the pump drive assembly includes or comprises a manifold and a pressure source. The manifold includes or comprises apertures that are adapted to be coupled adjacent respective ones of the chambers. The pressure source is adapted to be fluidly coupled to the apertures of the manifold to change a pressure within the apertures and to cause the linear peristaltic pump to pump fluid from the reservoir to the flow cell.

In accordance with another example, the chambers are responsive to an interface of a pump drive assembly with the deformable material.

In accordance with another example, the inlets are offset relative to respective ones of the outlets.

In accordance with another example, the body includes or comprises a mating surface to which the deformable material is coupled and the chambers are concave and include or comprise apexes. The inlets are positioned adjacent the mating surface on a first side of the respective chambers and the outlets are positioned adjacent the apexes of the chambers on a second side of the respective chambers.

In accordance with another example, the reagent cartridge is receivable within a cartridge receptacle of a system.

In accordance with another example, the body includes or comprises the reagent reservoir.

In accordance with another example, the reagent reservoir includes or comprises reagent reservoirs.

In accordance with another example, the reagent cartridge includes or comprises a flow cell receptacle. A flow cell is disposable within the flow cell receptacle.

In accordance with another example, the fluid is a reagent and the reagent reservoir contains the reagent.

In accordance with another example, each depression includes or comprises a fluid inlet and a fluid outlet and is fluidly coupled to at least one other depression. Actuating each portion of the deformable material to the first position includes or comprises covering the inlet of the depression with the portion of the deformable material and actuating each portion of the deformable material to the second position includes or comprises covering the outlet of the depression with the portion of the deformable material.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

DETAILED DESCRIPTION

Although the following text discloses a detailed description of example methods, apparatus, and/or articles of manufacture, it should be understood that the legal scope of the property right is defined by the words of the claims set forth at the end of this patent. Accordingly, the following detailed description is to be construed as examples only and does not describe every possible example, as describing every possible example would be impractical, if not impossible. Numerous alternative examples could be implemented, using either current technology or technology developed after the filing date of this patent. It is envisioned that such alternative examples would still fall within the scope of the claims.

The examples disclosed herein relate to linear peristaltic pumps for use with fluidic cartridges. The fluidic cartridges carry reagents and a flow cell (FC). The disclosed examples also relate to fluidic instruments (e.g., sequencing platforms) that are adapted to interface with the fluidic cartridges and drive the linear peristaltic pumps.

In an example, a linear peristaltic pump of a fluidic cartridge includes in-line discrete fluidic chambers that are part of a channel network. The chambers are sealed by a deformable material. The deformable material forms a top (or bottom) surface of the channel network. The pump can be positioned upstream and/or downstream of the flow cell and can be disposed on either side (or both sides) of the fluidic cartridge.

The pump can be driven by vertically pressing against the deformable material over two or more of the chambers in series. Driving the example pumps may create a pulsatile flow (a backwash flow profile) that increases flush efficiency of the flow cell. In addition or alternatively, the manner in which the pump is driven, sometimes referred to a "pump receipt," may result in a pulsatile flow. Additionally, when the example pumps are not being operated, in some examples, the pump acts as a reagent-selector valve that controls fluid flow through the fluidic cartridge. Thus, using the disclosed examples, less valves may be carried by the fluidic cartridge because the pumps function as a valve in addition to functioning as a pump. Moreover, by forming the pumps with the chambers and the deformable material, the fluidic cartridges disclosed herein can include a reduced number of parts, can be produced at less cost and can have a reduced level of complexity as compared to cartridges including known syringe pumps, for example.

Figure 1:
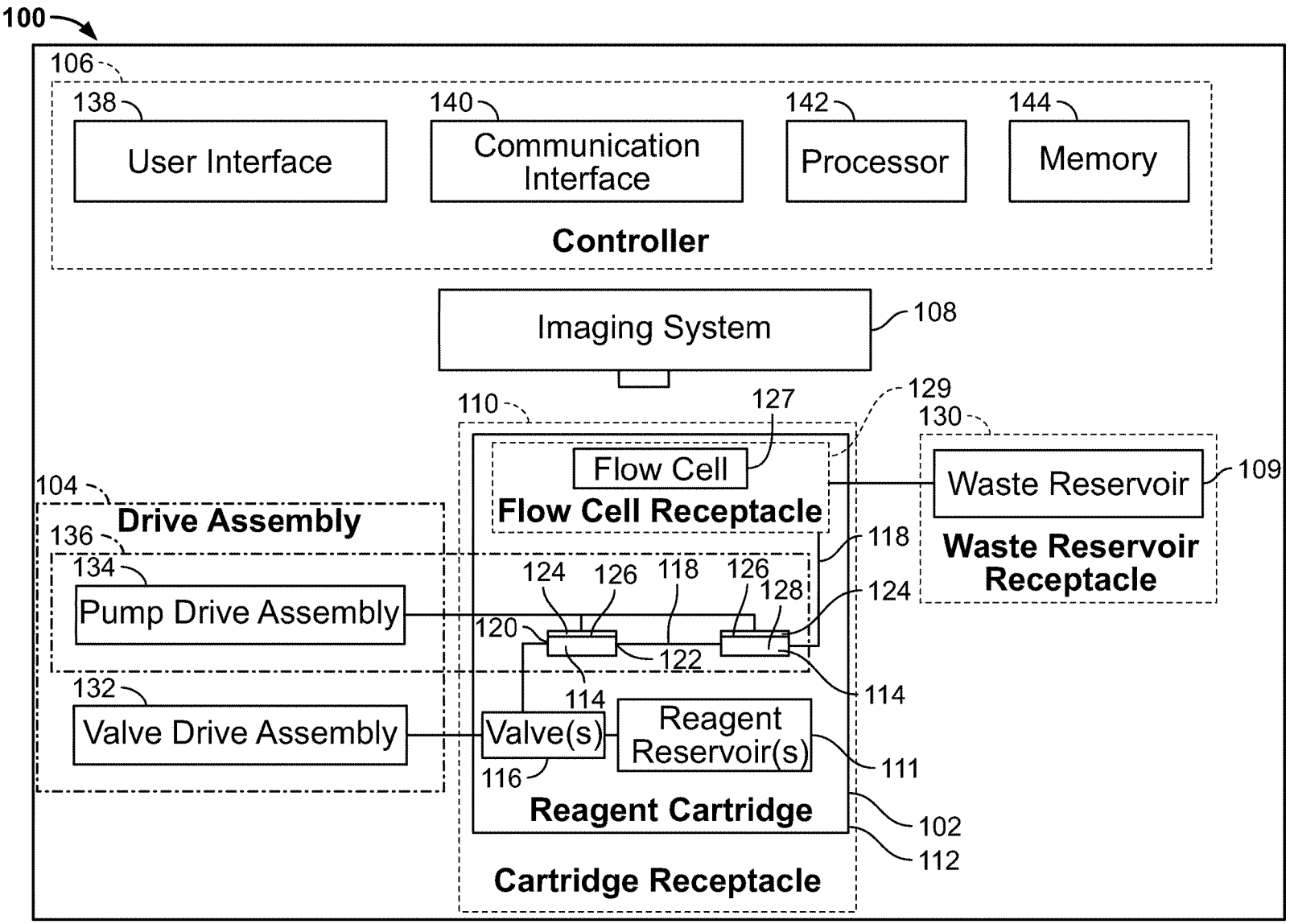
FIG. 1 illustrates a schematic diagram of an example system in accordance with the teachings of this disclosure.

FIG. 1 illustrates a schematic diagram of an example system 100 in accordance with the teachings of this disclosure. The system 100 can be used to perform an analysis on one or more samples of interest. The sample may include one or more DNA clusters that have been linearized to form a single stranded DNA (sstDNA). In the example shown, the system 100 is adapted to receive a reagent cartridge 102 and includes, in part, a drive assembly 104, a controller 106, an imaging system 108, and a waste reservoir 109. The controller 106 is electrically and/or communicatively coupled to the drive assembly 104 and to the imaging system 108 and is adapted to cause the drive assembly 104 and/or the imaging system 108 to perform various functions as disclosed herein.

The reagent cartridge 102 carries the sample of interest. Generally, to complete a cycle of sequencing using the example system 100, the drive assembly 104 interfaces with the reagent cartridge 102 to flow one or more reagents (e.g., A, T, G, C nucleotides) that interact with the sample through the reagent cartridge 102. In an example, a reversible terminator is attached to the reagent to allow a single nucleotide to be incorporated by the sstDNA per cycle. In some such examples, one or more of the nucleotides has a unique fluorescent label that emits a color when excited. The color (or absence thereof) is used to detect the corresponding nucleotide. In the example shown, the imaging system 108 is adapted to excite one or more of the identifiable labels (e.g., a fluorescent label) and thereafter obtain image data for the identifiable labels. The labels may be excited by incident light and/or a laser and the image data may include one or more colors emitted by the respective labels in response to the excitation. The image data (e.g., detection data) may be analyzed by the system 100. The imaging system 108 may be a fluorescence spectrophotometer including an objective lens and/or a solid-state imaging device. The solid-state imaging device may include a charge coupled device (CCD) and/or a complementary metal oxide semiconductor (CMOS).

After the image data is obtained, the drive assembly 104 interfaces with the reagent cartridge 102 to flow another reaction component (e.g., reagent) through the reagent cartridge 102 that is thereafter received by the waste reservoir 109. The reaction component chemically cleaves the fluorescent label and the reversible terminator from the sstDNA. The sstDNA is then ready for another cycle.

Referring to the reagent cartridge 102, in the example shown, the reagent cartridge 102 is receivable within a cartridge receptacle 110 of the system 100 and includes reagent reservoirs 111, a body 112 defining depressions (chambers) 114 and including valves 116, and fluidic lines 118. The reagent reservoirs 111 may contain fluid (e.g., reagent and/or another reaction component) and the valves 116 may be selectively actuatable to control the flow of fluid through the fluidic lines 118. One or more of the valves 116 may be implemented by a rotary valve, a pinch valve, a flat valve, a solenoid valve, a check valve, a piezo valve, etc. The body 112 may be formed of solid plastic using injection molding techniques and/or additive manufacturing techniques. In some examples, the reagent reservoirs 111 are integrally formed with the body 112. In other examples, the reagent reservoirs 111 may be separately formed and coupled to the body 112.

The depressions 114 are fluidly coupled via the fluidic line 118 and include inlets 120 and outlets 122. A deformable material 124 is coupled to a surface (a mating surface) 126 of the body 112 and covers the depressions 114 to define chambers 128. The deformable material 124 may be coupled to the body 112 using laser welding techniques, thermal bonding techniques, etc. The coupling between the body 112 and the deformable material 124 forms, for example, a hermetic seal between the body 112 and the deformable material 124. In some examples, the body 112 and/or the deformable material 124 defines one or more of the fluidic lines 118. The deformable material 124 may be elastically deformable allowing for the deformable material 124 to change shape if a force is applied thereto and enabling the deformable material 124 to naturally recover/return to its original shape once the force is removed.

The reagent cartridge 102 is in fluid communication with a flow cell 127. In the present implementation, the reagent cartridge 102 carries the flow cell 127 that is receivable within a flow cell receptacle 129. Alternatively, the flow cell 127 can be integrated into the reagent cartridge 102. In such examples, the flow cell receptacle 129 may not be included or, at least, the flow cell 127 may not be removably receivable within the reagent cartridge 102. As a further alternative, the flow cell 127 may be separate from the reagent cartridge 102.

In the example shown, the chambers 128 are positioned between the flow cell 127 and the reagent reservoirs 111. Thus, the chambers 128 are positioned downstream of the reagent reservoirs 111 and upstream of the flow cell 127. In alternative examples, the chambers 128 can be positioned downstream of the flow cell 127, such as between the flow cell 127 and the waste reservoir 109. The waste reservoir 109 is selectively receivable within a waste reservoir receptacle 130 of the system 100. While the chambers 128 are disclosed as being either upstream or downstream of the flow cell 127, alternatively, the chambers 128 can be positioned upstream and downstream of the flow cell 127.

Referring now to the drive assembly 104, in the example shown, the drive assembly 104 includes a valve drive assembly 132 and a pump drive assembly 134. The valve drive assembly 132 is adapted to interface with the respective valves 116 to control positions of the valves 116 between a closed position and an open position, for example.

The pump drive assembly 134, the body 112 including the depressions 114, and the deformable material 124 form a linear peristaltic pump 136. In other examples, the linear peristaltic pump 136 may be referred to as including the body 112 including the depressions 114 and the deformable material 124 but not including the pump drive assembly 134. Regardless, the pump drive assembly 134 is adapted to interface with the deformable material 124 by sequentially pressing the deformable material 124 into the depressions 114, thereafter releasing the deformable material 124 to draw reagent into the chambers 128 from the reagent reservoir 111 and then again pressing the deformable material 124 into one or more of the depressions 114 to urge the reagent forward (or backwards) through the fluidic line 118 of the reagent cartridge 102.

When the chambers 128 are positioned upstream of the flow cell 127 as shown, sequentially pressing the deformable material 124 moves reagent through the fluidic lines 118 between the chambers 128 and the flow cell 127 under positive pressure. Flowing the reagent through the fluidic lines 118 under positive pressure increases the flow rate through the reagent cartridge 102 and/or decreases a response time to flow the reagent into, for example, the flow cell 127. In some examples, under positive pressure, the reagent can flow through the fluidic lines 118 at up to about 4.5 milliliters per minute (min/mL) and/or 5.0 mL/min. However, other flow rates are achievable (e.g., 3.0 mL/min; 4.7 ml/min; 5.2 mL/min; 9 mL/min; 10 mL/min, etc.). When the chambers 128 are positioned downstream of the flow cell 127, sequentially or otherwise pressing the deformable material 124 moves reagent through the fluidic lines 118 between the chambers 128 and the flow cell 127 under negative pressure. In some examples, under negative pressure, reagent can flow through the fluidic lines 118 at up to about 3.0 mL/min. However, different flow rates are achievable (e.g., 3.2 mL/min; 3.3 mL/min, etc.).

Referring to the controller 106, in the example shown, the controller 106 includes a user interface 138, a communication interface 140, one or more processors 142, and a memory 144 storing instructions executable by the one or more processors 142 to perform various functions including the disclosed examples. The user interface 138, the communication interface 140, and the memory 144 are electrically and/or communicatively coupled to the one or more processors 142.

In an example, the user interface 138 is adapted to receive input from a user and to provide information to the user associated with the operation of the system 100 and/or an analysis taking place. The user interface 138 may include a touch screen, a display, a key board, a speaker(s), a mouse, a track ball and/or a voice recognition system. The touch screen and/or the display may display a graphical user interface (GUI).

In an example, the communication interface 140 is adapted to enable communication between the system 100 and a remote system(s) (e.g., computers) via a network(s). The network(s) may include an intranet, a local-area network (LAN), a wide-area network (WAN), the intranet, etc. Some of the communications provided to the remote system may be associated with analysis results, imaging data, etc. generated or otherwise obtained by the system 100. Some of the communications provided to the system 100 may be associated with a fluidics analysis operation, patient records and/or a protocol(s) to be executed by the system 100.

The one or more processors 142 and/or the system 100 may include one or more of a processor-based system(s) or a microprocessor-based system(s). In some examples, the one or more processors 142 and/or the system 100 includes a reduced-instruction set computer(s) (RISC), an application specific integrated circuit(s) (ASICs), a field programmable gate array(s) (FPGAs), a field programmable logic device(s) (FPLD(s)), a logic circuit(s) and/or another logic-based device executing various functions including the ones described herein.

The memory 144 can include one or more of a hard disk drive, a flash memory, a read-only memory (ROM), erasable programmable read-only memory (EPROM), electrically erasable programmable read-only memory (EEPROM), a random-access memory (RAM), non-volatile RAM (NVRAM) memory, a compact disk (CD), a digital versatile disk (DVD), a cache, and/or any other storage device or storage disk in which information is stored for any duration (e.g., permanently, temporarily, for extended periods of time, for buffering, for caching).

Figure 2:
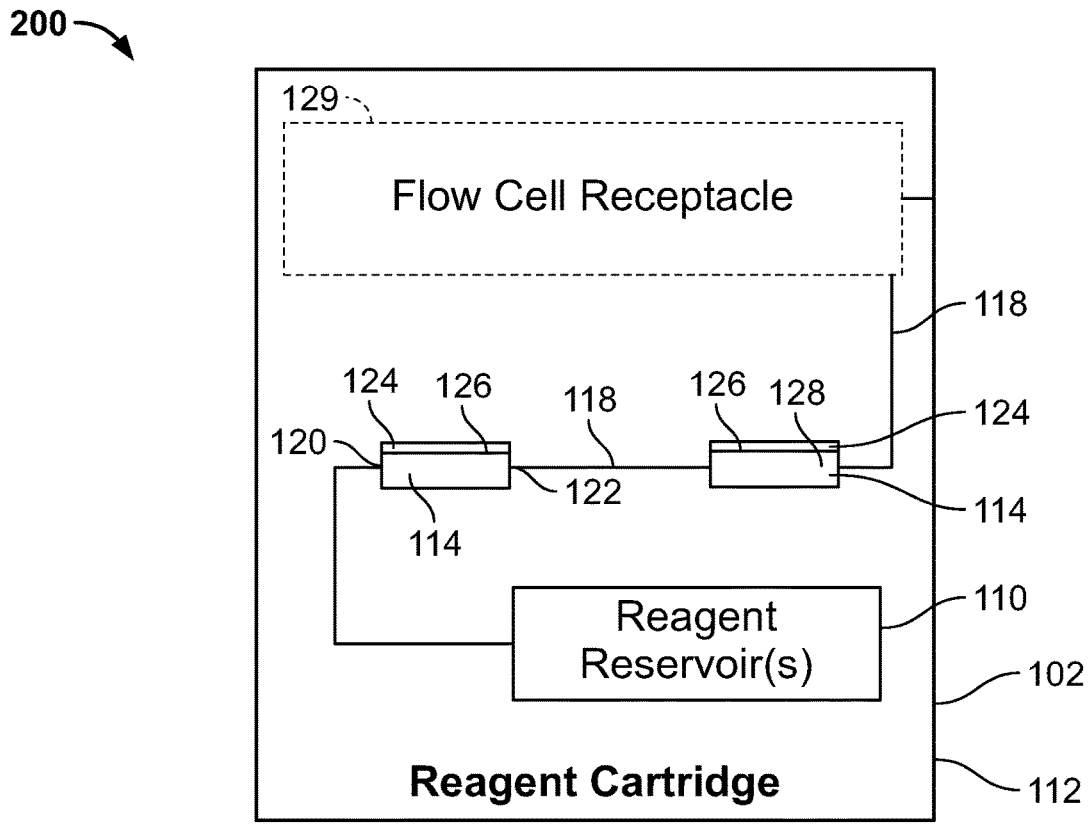
FIG. 2 illustrates a schematic diagram of another reagent cartridge receivable within the cartridge receptacle of the system of FIG. 1.

FIG. 2 illustrates a schematic diagram of another reagent cartridge 200 in accordance with the teachings of this disclosure. The reagent cartridge 200 may be receivable within the cartridge receptacle 110 of FIG. 1. Elements of the reagent cartridge 200 which are the same or similar to the reagent cartridge 102 of FIG. 1 are designated by the same reference numeral. A description of these elements is abbreviated or eliminated in the interest of brevity. In contrast to the reagent cartridge 102 of FIG. 1, the reagent cartridge 200 of FIG. 2 does not include the valves 116 and is not carrying the flow cell 127.

Figure 3:
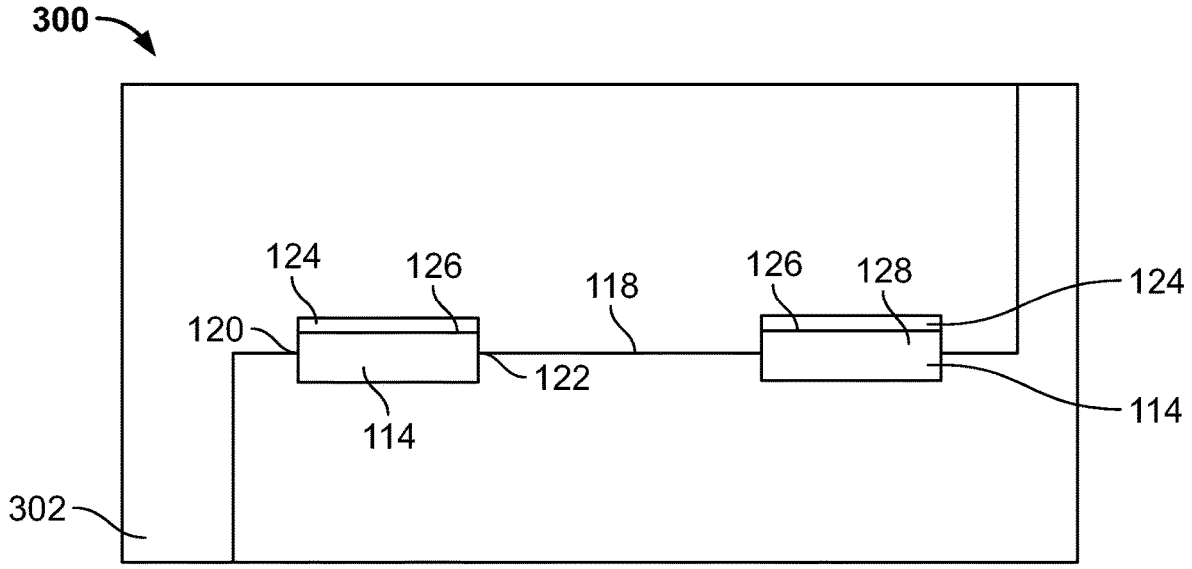
FIG. 3 illustrates at least a portion of a linear peristaltic pump in accordance with the teachings of this disclosure.

FIG. 3 illustrates a schematic diagram of at least a portion of a linear peristaltic pump 300 in accordance with the teachings of this disclosure. Elements of the linear peristaltic pump 300 which are the same or similar to the linear peristaltic pump 136 are designated by the same reference numeral. In the example shown, the portion of the linear peristaltic pump 300 includes a body 302 having the mating surface 126 and defining the depressions 114. The deformable material 124 is coupled to the mating surface 126 and covers the depressions 114. In some examples, the inlet 120 is vertically offset relative to the outlet 122 (see, for example, FIG. 5).

Figure 4:
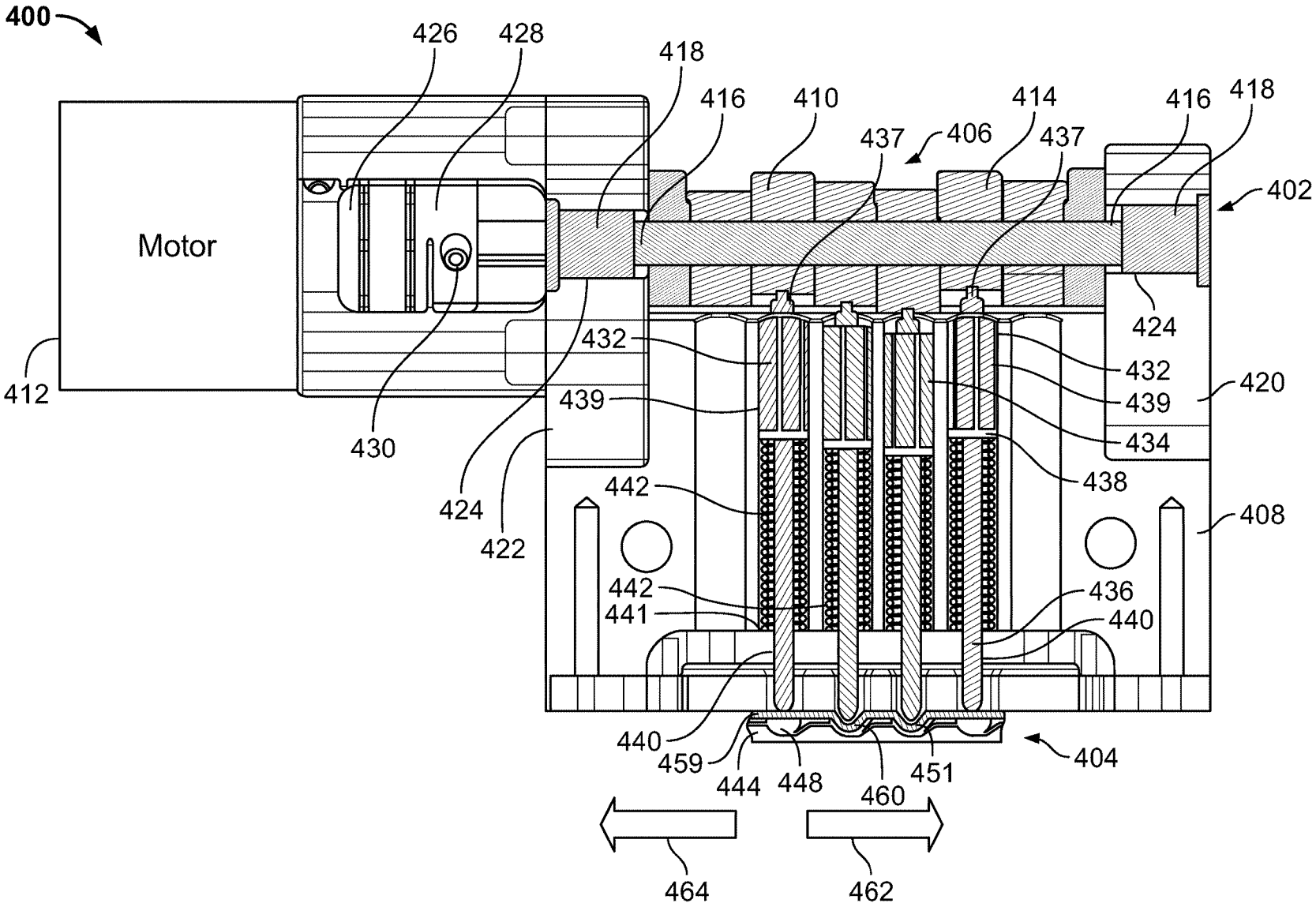
FIG. 4 is a cross-sectional view of an example linear peristaltic pump including a pump drive assembly that can be used to implement a linear peristaltic pump of the system of FIG. 1.

FIG. 4 is a cross-sectional view of an example linear peristaltic pump 400 in accordance with the teaching of this disclosure. The linear peristaltic pump 400 may be used to implement the linear peristaltic pump 136 of the system 100 of FIG. 1. The linear peristaltic pump 400 includes a pump drive assembly 402 and a reagent cartridge 404. Generally, the pump drive assembly 402 is adapted to interface with the reagent cartridge 404 to pump fluid through the reagent cartridge 404 during one or more fluidic operations as disclosed herein.

In the example shown, the pump drive assembly 402 includes an actuator 406 and a guide 408. The actuator 406 includes a cam shaft 410 and a motor 412. The cam shaft 410 includes lobes 414. The motor 412 is adapted to rotate the cam shaft 410 and the lobes 414. When the cam shaft 410 is rotated, the revolutions per minute (rpm) of the cam shaft 410 is associated with a flow rate of the linear peristaltic pump 400, a number of revolutions of the cam shaft 410 is associated with a volume of the fluid metered through the reagent cartridge 404, and the direction that the cam shaft 410 is rotated is associated with the direction that fluid flows through the reagent cartridge 404 (e.g., left to right shown by arrow 462 or right to left shown by arrow 464 as shown in FIG. 4). The lobes 414 are designed to define how reagent is pumped through the linear peristaltic pump 400 when the cam shaft 410 is rotated. How the reagent is pumped may be referred to as "a pump receipt."

The cam shaft 410 also includes a shaft 416 and bearings 418. The shaft 416 extends through the lobes 414 of the cam shaft 410 and the bearings 418. In some implementations, the shaft 416 and the lobes 414 can be a single component. The guide 408 includes flanges 420, 422. The flanges 420, 422 are spaced from one another and define apertures 424. The apertures 424 are sized to receive a corresponding bearing 418. The cam shaft 410 is positioned and journalled between the flanges 420, 422.

The motor 412 of the actuator 406 may be an electric motor, a direct current (DC) motor, a stepper motor, a piezoelectric motor, etc. The motor 412 includes a motor shaft 426. A collar (a clamping collar) 428 is coupled to the motor shaft 426. The collar 428 receives and is coupled to the motor shaft 426 of the cam shaft 410. A fastener 430 is threadably received by the collar 428. In some examples, tightening the fastener 430 decreases a diameter of the collar 428 to secure the shaft 416 within the collar 428. In other examples, tightening the fastener 430 drives an end of the fastener 430 against the shaft 416 to secure the shaft 416 within the collar 428.

The lobes 414 of the cam shaft 410 are adapted to interface with rods (cam followers) 432 to cause the rods 432 to move into and out of an extended position. The rods 432 include a first portion 434 and a second portion 436. A shoulder serving as a spring seat 438 is defined by the rods 432 between the first and second portions 434, 436. Distal ends of the first portions 434 of the rods 432 include projections 437 that extend toward and interface with the lobes 414 of the cam shaft 410. Distal ends of the second portions 436 of the rods 432 are rounded and are adapted to interface with the reagent cartridge 404.

The guide 408 defines first guide bores 439 and second guide bores 440. Respective ones of the first and second guide bores 439, 440 are coupled and are coaxially aligned. The first guide bores 439 are positioned adjacent to the actuator 406 and the second guide bores 440 are positioned adjacent to the reagent cartridge 404. The first guide bores 439 have a larger diameter than the second guide bores 440. A shoulder serving as a spring seat 441 is defined by the guide 408 between the first and second guide bores 439, 440.

Springs 442 are disposed within the first guide bores 439 between the spring seats 438, 441. The springs 442 urge the rods 432 away from the reagent cartridge 404 and into a retracted position. In other examples, the springs 442 urge the rods 432 toward the reagent cartridge 404 and into the extended position. In the extended position, the rods 432 can interact with the reagent cartridge 404 to prevent or otherwise reduce fluid flow through the reagent cartridge 404.

Figure 5:
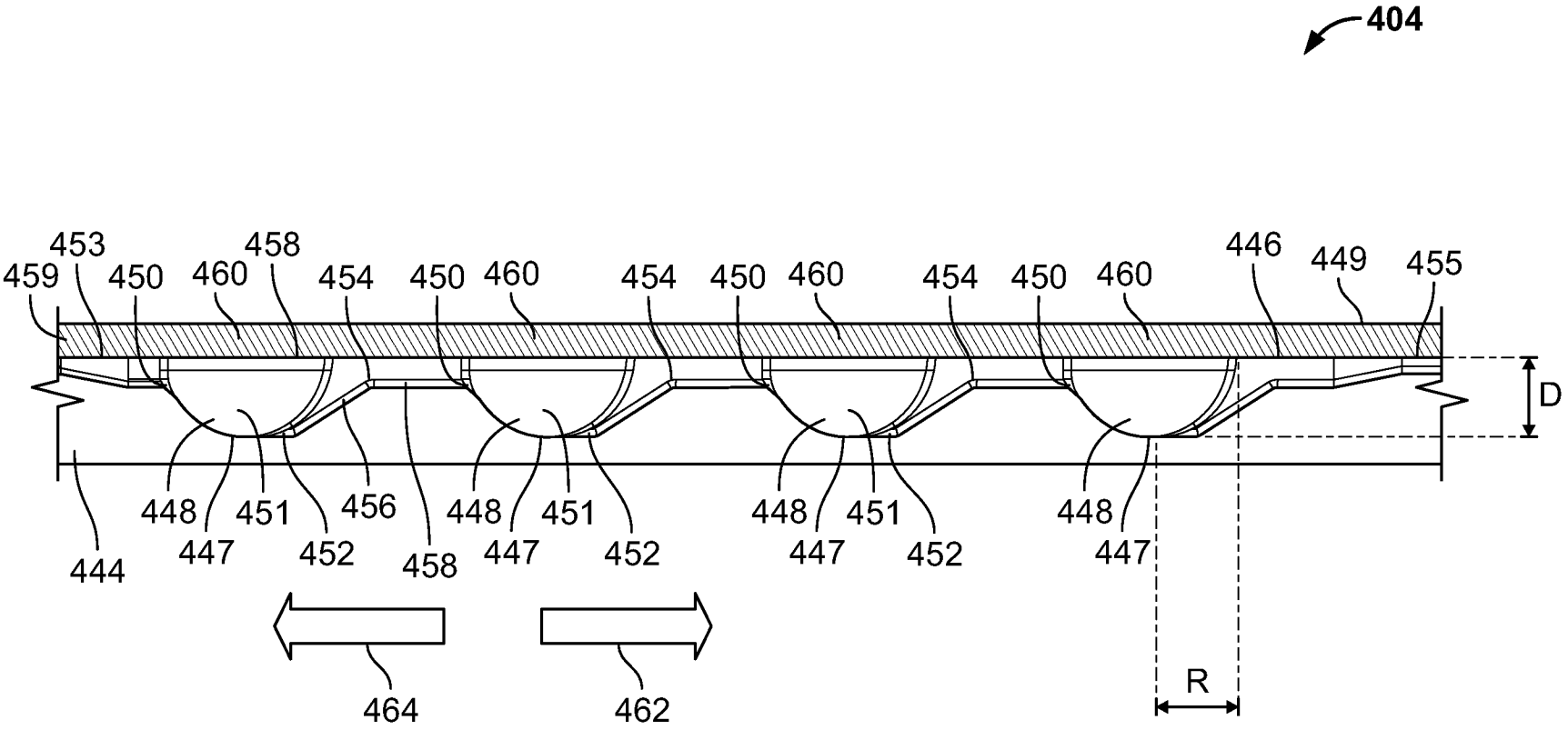
FIG. 5 is a cross-sectional view of a portion of a body of the reagent cartridge of FIG. 2 illustrating one of the groups of chambers and a deformable material.

Referring to FIG. 5, a detailed view of the reagent cartridge 404 is shown. In the illustrated example, the reagent cartridge 404 includes a body 444 having a mating surface 446 and defining depressions 448. The depressions 448 are concave and are dome shaped. In some examples, the depressions 448 each have a volume of about 23 microliters (μL), have a radius R of about 2.5 millimeters (mm) and have a depth D of about 2.4 mm. Said another way, in this example, the radius is greater than the depth. However, one or more of the depressions 448 may have a different volume (e.g., 19 μL, 21 μL, 25 μL, 26.2 μL, etc.), may have a different shape (e.g., oblong, prismatic, etc.), and/or may have different radial and/or depth dimensions (1.9 mm, 2.1 mm, 2.6 mm, 2.9 mm, 3.1 mm, etc.). Furthermore, while the depressions 448 are illustrated as having the same size and shape (cross-section), one or more of the depressions 448 may be different from others of the depressions 448 and/or each of the depressions 448 may have a different size and/or shape.

Each depression 448 includes an inlet 450 and an outlet 452. The inlets 450 may be associated with a relatively shallow-seated entrance path and the outlets 255 may be associated with a relatively deep-seated exit path. The inlets 450 are positioned on a first upstream side of the depressions 448 proximate to the mating surface 446 and the outlets 452 are positioned on a second downstream side of the depressions 448 proximate to an apex 447 of the depression 448. A distance between the inlets 450 and the mating surface 446 is less than a distance between the outlets 452 and the mating surface 446. Thus, the inlets 450 are closer to the mating surface 446 than the outlets 452.

A fluidic line 454 is coupled to and between the inlet 450 and the outlet 452 of the immediately upstream depression 448. In the example shown, the fluidic line 454 includes a first portion (a first leg) 456 and a second portion (a second leg) 458. The first portion 456 of the fluidic line 454 is coupled to the outlet 452 of the depression 448 and extends toward the mating surface 446 at about a 45° relative to the second portion 458 of the fluidic line 454. The second portion 458 of the fluidic line 454 is coupled to the inlet 450 of the depression 448 and is substantially parallel to the mating surface 446. As set forth herein, the phrase "substantially parallel" accounts for manufacturing tolerances and/or means +/−5° of parallel including being parallel itself. Because of the positioning of the inlets 450 and the outlets 452 and the associated fluidic lines 454, the inlets 450 and the outlets 452 are vertically offset relative to one another. However, the first portion 456 may extend at any angle (e.g., 30°, 43°, 47°, 53°, etc.) relative to the second portion 458 including 0° such that the first and second portions 456, 458 are continuous with each other. In one such example, the inlets 450 and the outlets 452 are in line with one another and the first and second portions 456, 458 are substantially parallel to the mating surface 446. Furthermore, the second portion 458 of the fluidic line 454 may be positioned at any other angle (e.g., 4°, 7° 11° 13°, etc.) relative to the mating surface 446 other than being substantially parallel to the mating surface 446.

A deformable material 459 is coupled to the mating surface 446 and covers the depressions 448 to form respective chambers 451. The deformable material 459 may be a thermoplastic elastomer such as, for example, Dnyaflex™ TPE, 39A and may have a thickness of about 1 millimeter. However, a different material may be used and/or the deformable material 459 may have a different thickness (e.g., 0.6 mm, 0.75 mm, 0.82 mm, 1.2 mm, 1.5 mm, etc.) or may even have a varying thickness across its entirety. Additionally, the deformable material 459 may be formed of materials having a different durometer and/or may be formed of materials including silicone, santaprene thermoplastic vulcanistates (TPV), thermoplastic elastomers, thermoplastic polyurethane (TPU), etc.

In the example shown, a first portion 453 of a first surface 455 of the deformable material 459 is coupled to the mating surface 446 and a second portion 458 of the first surface 455 covers the respective depressions 448. The first and second portions 453, 458 of the first surface 455 are shown coplanar in FIG. 5. However, in other examples such as those described in connection with FIGS. 15-20, the first and second portions 453, 458 are not coplanar. Alternatively, while a second surface 449 of the deformable material 459 and the first surface 455 are shown substantially parallel in FIG. 5, in the examples shown below in FIGS. 15-20, portions of the first and second surfaces 455, 449 are not coplanar with other portions of the first and second surfaces 455, 449, for example.

Referring back to FIG. 4 with reference to FIG. 5, to flow reagent out of the outlets 452 and in through the inlets 450, in the example shown, the motor 412 rotates the cam shaft 410 and the lobes 414 engage the projections 437 of the rods 432 to drive one or more of the rods 432 toward the extended position to depress the deformable material 459 while allowing one or more of the rods 432 to move toward or remain in the retracted position and not depress the deformable material 459. In some examples, a distance that the deformable material 459 moves between the first and second positions is about 0.7 mm. However, the deformable material 459 may be moved different distances (e.g., 0.4 mm, 0.6 mm, 0.75 mm, etc.) to achieve different flow rates and/or volumes. For example, the deformable material 459 may be moved up or down depending on whether positive pressure or negative pressure is being generated to define a specified volume of fluid delivered.

In the extended position, the rods 432 engage (depress) a portion 460 of the deformable material 459 and urge the deformable material 459 into a dimensional envelope of the depression 448. In some examples, to provide a single direction flow preference, the inlet 450 is sealed before the outlet 452 when the deformable material 459 is pressed into the associated depression 448, toward occupying the second position. In the example shown, the middle two of the rods 432 are in the second position and are depressing the deformable material 459.

In the retracted position, the rods 432 allow the deformable material 459 to recover/return to its original shape outside of the dimensional envelope of the depression 448. In the example shown, the outer two rods 432 are in the first position and are not depressing the deformable material 459. While the rods 432 are positioned as shown in FIG. 4, the lobes 414 of the cam shaft 410 can be positioned, formed, and/or arranged to move the rods 432 in any order. For example, all of the rods 432 may be in the extended position, none of the rods 432 may be in the extended position, the first two rods 432 may be in the extended position, the first three rods 432 may be in the retracted position, etc. Additionally, in an example, some of the rods 432 are selected for actuation and others of the rods 432 are not selected for actuation.

When urging the reagent through the reagent cartridge 404 in a direction generally indicated by arrow 462, in some examples, the deformable material 459 is sequentially depressed into the dimensional envelope of two immediately adjacent depressions 448. As a result, the deformable material 459 sealingly engages the inlet 450 and then the outlet 452 of the chamber 451 allowing for an amount of the reagent that flows in a direction generally opposite the direction indicated by arrow 462 to be reduced. To encourage a backwash flow profile, the deformable material 459 may be depressed within the respective depressions 448 one at a time such that the reagent flows in the direction generally indicated by the arrow 462 and the direction generally indicated by the arrow 464. However, the deformable material 459 covering the depressions 448 may be depressed in different ways to achieve a backwash flow profile or another desired flow profile.

In other examples, when the linear peristaltic pump 400 is operated, reagent may flow in opposite directions (upstream and downstream) out of the inlet 450 and the outlet 452 when the deformable material 459 is moving into the second position and reagent may flow into the chamber 451 from both directions (upstream and downstream) when the deformable material 459 is moving into the first position. However, in some examples and as a result of the relative positions of the inlet 450 and the outlet 452 and the portions 456, 458 of the fluidic line 454, more reagent flows out of the outlet 452 as compared to an amount of the reagent that flows in through the inlet 450 when the deformable material 459 moves into the second position and more reagent flows in through the inlet 450 as compared to an amount of the reagent that flows out through the outlet 452 when the deformable material 459 moves into the first position.

While less fluid may flow through one of the inlets 450 or the outlets 452 depending on the direction that the deformable material 459 is moving, in some examples, when the deformable material 459 is depressed into the depressions 448, reagent may flow out of the associated inlets 450 and outlets 452 in directions generally indicated by arrows 462, 464 in a pulsatile manner and, when the portion 460 of the deformable material 459 returns from the depressed state, reagent may flow in through the associated inlets 450 and outlets 452 in directions generally opposite that indicated by arrows 462, 464 in a pulsatile manner. This pulsatile flow creates a backwash flow profile. The phrase "pulsatile flow" can be defined such as fluidically flowing a first predetermined volume of fluid downstream in a fluidic path before flowing a second volume of fluid upstream in the fluidic path, where the first predetermined volume is greater than the second volume (e.g., 2 mL of fluid flowed downstream and 0.5 mL of fluid moving upstream or backwashing). In an example, the first predetermined volume is associated with opening a valve for a threshold amount of time and/or pumping a threshold volume of fluid through the reagent cartridge 404. As set forth herein, the phrase "backwash flow profile" refers to a flow state when the direction of the flow alternates. A backwash flow profile can be advantageous in increasing flush efficiency through the reagent cartridge 404. Specifically, a flow that quickly changes directions such as that provided by a backwash flow profile may effectively wash out areas (e.g., corners or bends in the fluidic lines) of the reagent cartridge 404 that may be otherwise difficult to wash while using less wash buffer, for example.

As a result of implementing reagent cartridges with the disclosed examples, in some examples, a volume of reagent (e.g., wash buffer) may be reduced by approximately 50% and a volume of the reagent cartridge 404 may be reduced by about 30% as compared to other cartridges and volumes of reagents. While a backwash flow profile may be created by depressing the deformable material 459 and/or by depressing the deformable material 459 in a particular manner, a backwash flow profile may also be created by driving the linear peristaltic pump associated with the chambers 451 in reverse. Thus, the linear peristaltic pumps disclosed are bi-directional.

Figure 6:
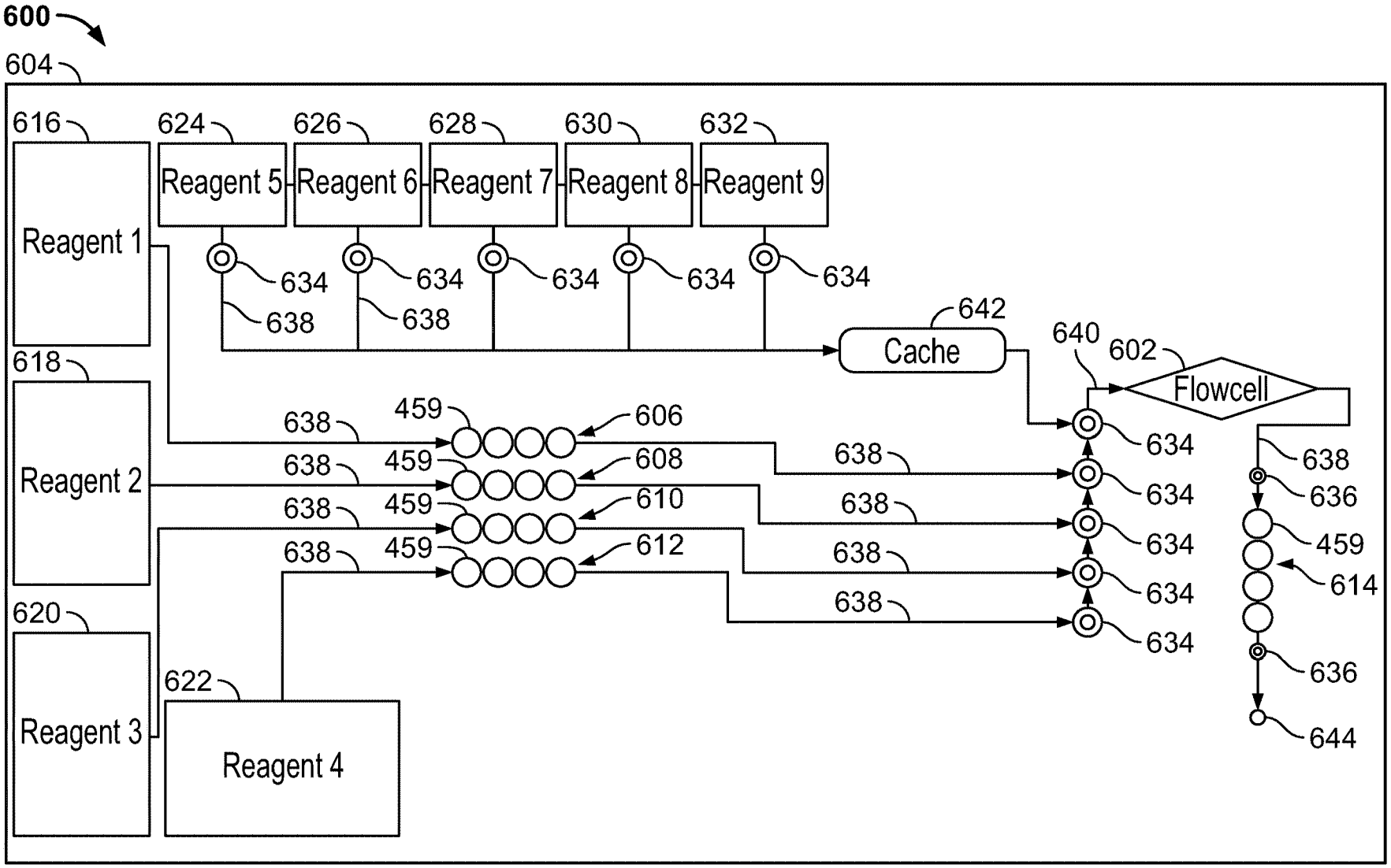
FIG. 6 illustrates a schematic diagram of an example reagent cartridge receivable within a cartridge receptacle of the system of FIG. 1.
Figure 7:
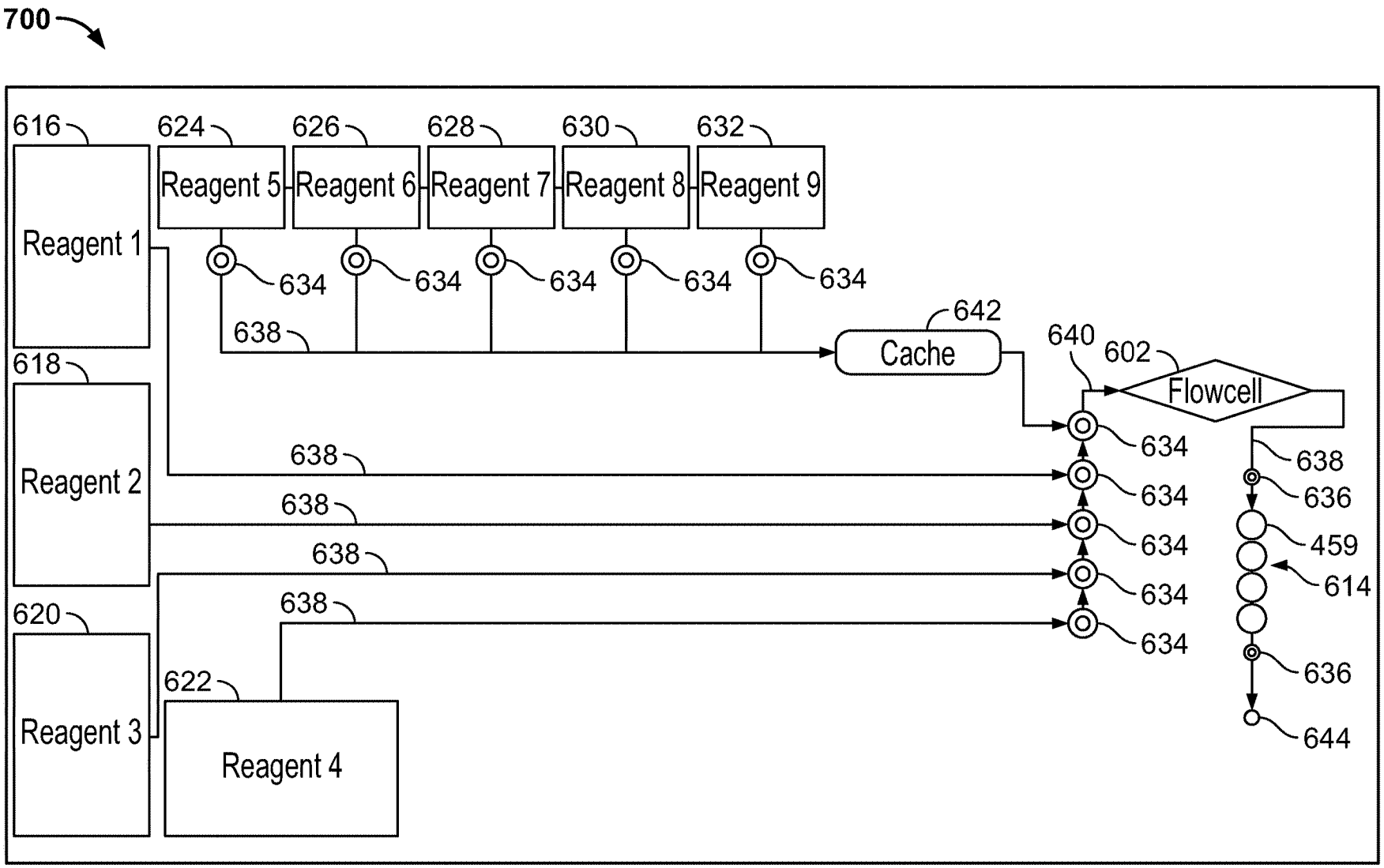
FIG. 7 illustrates a schematic diagram of another example reagent cartridge receivable within a cartridge receptacle of the system of FIG. 1.

While the examples disclosed above illustrate the reagent cartridge 404 including a single group of chambers 451 (FIGS. 4 and 5), the reagent cartridges may include any number of groups of chambers 451 that are used to flow fluid under positive and/or negative pressure through the fluidic lines during one or more fluidic procedures. One such detailed example of a reagent cartridge 600 is illustrated in FIG. 6 and another such detailed example of a reagent cartridge 700 is illustrated in FIG. 7. These reagent cartridges 600, 700 may be receivable within the cartridge receptacle 110 of the system 100 of FIG. 1 and are adapted to interface with the drive assembly 104 of the system 100 to perform the fluidic and/or analysis operations disclosed.

Referring to FIG. 6, the reagent cartridge 600 carries a flow cell 602 and includes a body 604, first, second, third, fourth, and fifth groups 606, 608, 610, 612, 614 of the chambers 451 (the chambers 451 are most clearly shown in FIG. 5), reagent reservoirs 616 through 632, and valves 634, 636, all of which are fluidly coupled by fluidic lines 638.

In the example shown, each of the first thru fifth groups 606-614 of the chambers 451 is adapted to interface with the pump drive assembly 134 to form respective linear peristaltic pumps. The first thru fourth groups 606, 608, 610, 612 of the chambers 451 are positioned upstream of the flow cell 602 and the fifth group 614 of the chambers 451 is positioned downstream of the flow cell 602. Each of the first thru fourth groups 606, 608, 610, 612 of the chambers 451 are dedicated to one of the reagent reservoirs 616, 618, 620, 622 and can be operated independently and/or simultaneously. By providing one linear peristaltic pump to each of the reagent reservoirs 616, 618, 620, 622 positioned ahead of a common fluidic line 640, the likelihood of contamination occurring between the reagents associated with the reagent reservoirs 616-622 is reduced. When operating the linear peristaltic pumps associated with respective ones of the first through fourth groups 616-622 of the chambers 451, reagent is selectively drawn from the respective reagent reservoirs 616-622 and urged toward the flow cell 602 under positive pressure.

By operating two or more of the linear peristaltic pumps substantially simultaneously or sequentially, reagent from the reagent reservoirs 616, 618, 620, 622 can be mixed within a mixing region of the reagent cartridge 600 and/or within the flow cell 602. Mixing the reagent using the disclosed linear peristaltic pumps is advantageous when, for example, re-suspending lyophilized reagents. The lyophilized reagents can be resuspended by, for example, driving the linear peristaltic pumps associated with the groups 606, 608, 610, 612 at substantially the same time.

When operating the liner peristaltic pump associated with the fifth group 614, reagent is drawn from one or more of the fifth thru ninth reagent reservoirs 616-632 under negative pressure. Reagent drawn from one or more of the fifth through ninth reagent reservoirs 624-632 can be stored in a cache 642 (e.g., a mixing region) of the reagent cartridge 600 prior to being drawn into the flow cell 602. In some examples, to deter back flow when operating the linear peristaltic pump associated with the fifth group 614, the valves 636 are implemented by pinch valves and/or check valves positioned upstream and downstream of the group 614 of the chambers 451. After the reagent passes through the chambers 451 of the fifth group 614, the fluid exits the reagent cartridge 600 at an outlet 644 that is adapted to be fluidly coupled to the waste reservoir 109.

In an example, one or more of the groups 606-614 of the chambers 451 have a length of about 48 millimeters (mm) and a width of about 15 mm. Thus, each of the groups 606-614 may not take up a relatively large amount of real estate on the reagent cartridge 600. However, one or more of the groups 606-614 of the chambers 451 may include a different length (e.g., 44 mm, 45 mm, 50 mm, etc.) and/or may have a different width. In the example shown, each of the groups 606-614 includes four of the chambers 451. However, in other examples, one or more of the groups 606-614 may include more than four chambers 551 (e.g., five chambers, six chambers, etc.) and/or one or more of the groups 606-614 may include less than four chambers 451 (e.g., two chambers, three chambers, etc.).

Referring now to FIG. 7, the reagent cartridge 700 is similar to the reagent cartridge 600 of FIG. 6. However, in contrast to the reagent cartridge 600 of FIG. 6, the reagent cartridge 700 of FIG. 7 does not include the first thru fourth groups 606-612 of the chambers 451. Thus, instead of urging reagent from the reagent reservoirs 616-622 under positive pressure, reagent is drawn from one or more of the reagent reservoirs 616-622 under the negative pressure provided by the fifth group 614 of the chambers 451 and the associated deformable material 459.

In the example shown, the fluid can be pumped through the reagent cartridge 700 in different ways. In a first example, the valve 634 associated with the first reagent reservoir 616 is opened and the deformable material 459 over one or more of the depressions 448 is actuated to draw the reagent toward the flow cell 602. In a second example, the valve 634 associated with the first reagent reservoir 616 is closed while the deformable material 459 over one or more of the depressions 448 is depressed (closed) to vent existing pressure within the reagent cartridge 700 and then the deformable material 459 is released (opened) to create a vacuum. Once a threshold vacuum has been created, the valve 634 associated with the first reagent reservoir 616 is opened and then closed to draw a metered volume of the reagent toward the flow cell 602. In this manner, a volume of reagent drawn through the flow cell 602 can be controlled. However, the valve 634 can be actuated in alternative ways (e.g., leaving the valve 634 open after actuating).

Figure 8:
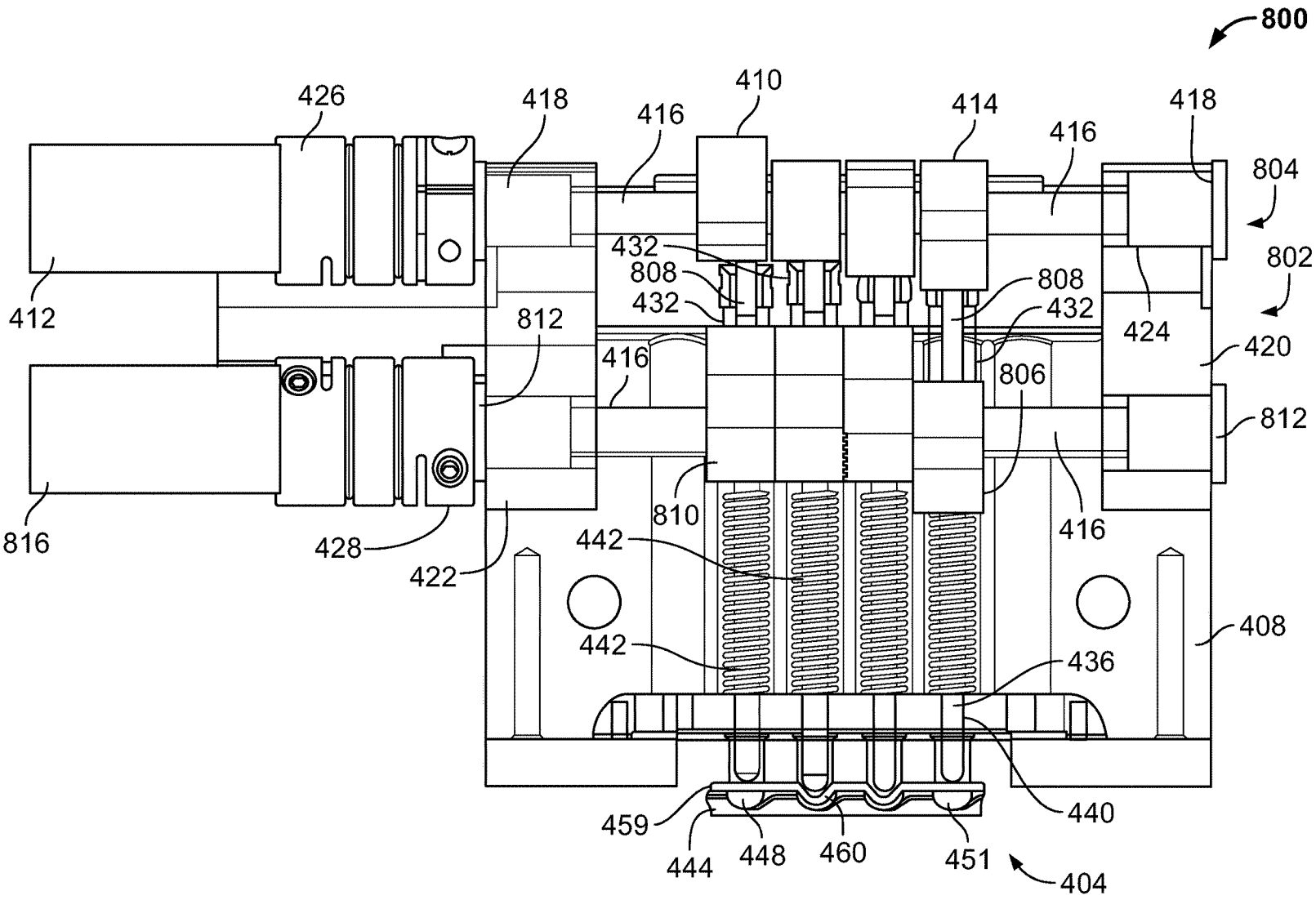
FIG. 8 is a side view of another example linear peristaltic pump including a pump drive assembly that can be used to implement a linear peristaltic pump of the system of FIG. 1.

FIG. 8 is a side view of another example linear peristaltic pump 800 in accordance with the teaching of this disclosure. The linear peristaltic pump 800 may be used to implement the linear peristaltic pump 136 of the system 100 of FIG. 1. The linear peristaltic pump 800 includes a pump drive assembly 802 and the reagent cartridge 404. Elements of the pump drive assembly 802 which are the same or similar to the pump drive assembly 402 are designated by the same reference numeral. A description of these elements is abbreviated or eliminated in the interest of brevity.

In the example shown, the pump drive assembly 802 includes an actuator 804 including the first cam shaft 410, a second cam shaft 806, and rocker arms 808. Generally, the rotational position of the second cam shaft 806 is used to change the height of the rocker arms 808 and, in turn, to selectively allow the first cam shaft 410 to interface with a corresponding one of the rocker arms 808 and control a volume of reagent pumped.

The first cam shaft 410 includes the lobes 414, is rotated by the motor 412 and is journalled between the flanges 420, 422. The second cam shaft 806 also includes lobes 810, bearings 812 and the shaft 416 that extends through the lobes 810, and the bearings 812. The actuator 804 also includes a motor 816 that is coupled to the shaft 416, via the collar 428. In the example shown, rotating the second cam shaft 806 allows the deformable material 459 over one or more of the depressions 448 to be selected for actuation. Positioning more of the rocker arms 808 to be engaged by the lobes 414 of the first cam shaft 410 increases the volume of reagent pumped through the chambers 541 when the first cam shaft 410 is rotated and positioning the rocker arms 808 to be engaged by less of the lobes 414 of the first cam shaft 410 decreases the volume of reagent pumped through the chambers 541.

For example, the second cam shaft 806 may be positioned to raise two of the rocker arms 808 to allow engagement by the lobes 414 of the first cam shaft 410 and to lower two of the rocker arms 808 to prevent engagement by the lobes 414 of the first cam shaft 410. As a result, driving the first cam shaft 410 actuates two of the rods 432 into engagement with the deformable material 459 but does not actuate the other two rods 432, thereby allowing a lesser volume of reagent to be pumped through the reagent cartridge 404.

Figure 10:
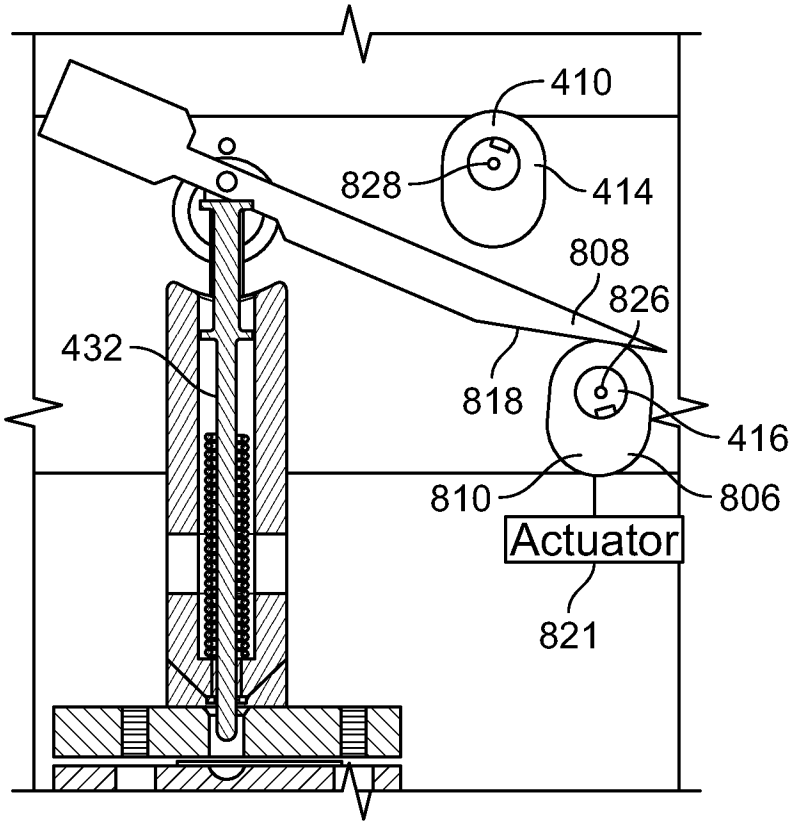
FIG. 10 illustrates a detailed cross-sectional view of the first cam, the second cam, and one of the rocker arms of the linear peristaltic pump of FIG. 9 in a second position.
Figure 9:
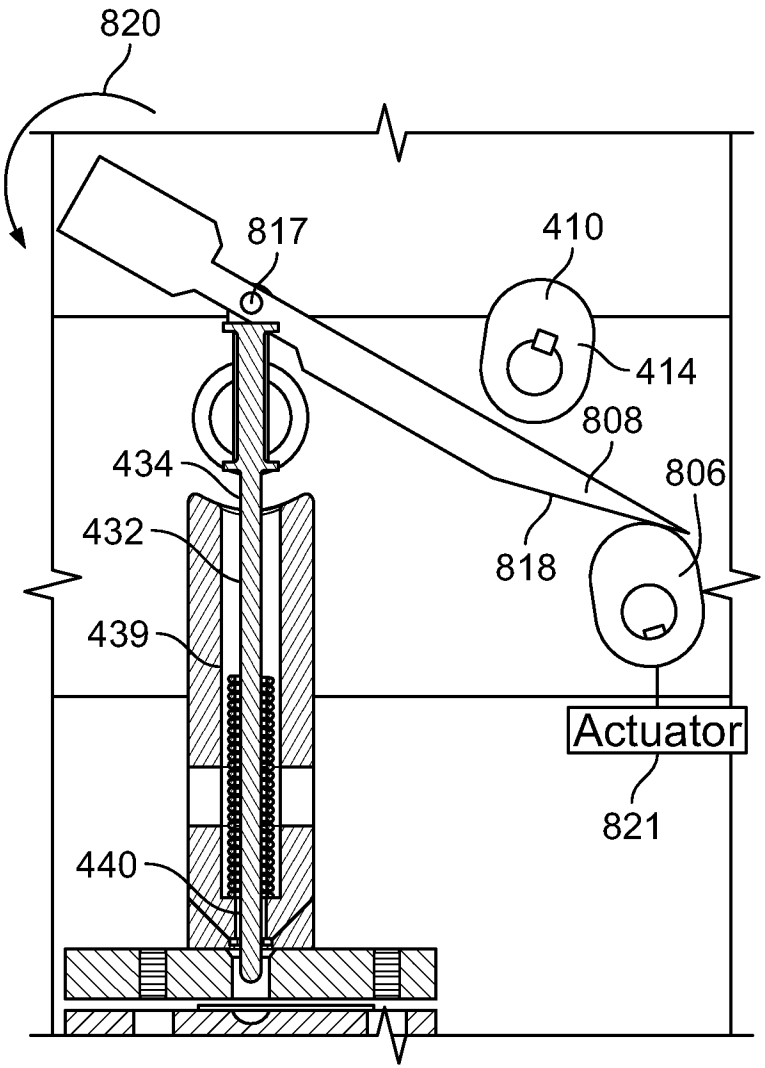
FIG. 9 illustrates a detailed cross-sectional view of a first cam, a second cam, and one of the rocker arms of the linear peristaltic pump of FIG. 8 in a first position.

Referring to FIGS. 9 and 10, a detailed cross-sectional view of the first cam shaft 410, the second cam shaft 806, and one of the rocker arms 808 is shown. In the example shown, a pin 817 extends through the first portion 434 of the rod 432. The pin 817 pivotably couples the rod 432 and the rocker arm 808. The rocker arm 808 is adapted to move along an arched path and the rod 432 is adapted to be linearly guided within the first and second guide bores 439, 440.

The rocker arm 808 includes a tapered surface 818. The tapered surface 818 is adapted to engage the second cam shaft 806. As a result, depending on the rotational position of the second cam shaft 806, the second cam shaft 806 raises or lowers the rocker arm 808 relative to the first cam shaft 410. Alternatively, the rocker arm 808 may not include the tapered surface 818. The first cam shaft 410 may be referred to as a main cam and the second cam shaft 806 may be referred to as a selector cam. In the raised position (a first position) of the rocker arm 808 shown in FIG. 9, the lobe 414 of the first cam shaft 410 is able to engage the rocker arm 808 to rotate the rocker arm 808 in a direction generally indicated by arrow 820 and linearly move the rod 432 within the guide bores 439, 440. In the example shown, an actuator 821 is coupled to the second cam shaft 806. The actuator 821 may be a linear actuator. Alternatively, the actuator 821 may be excluded.

In the illustrated example, the actuator 821 is adapted to move the second cam shaft 806 in directions generally indicated by arrows 822, 824. To increase a volume of the reagent pumped by each stroke of the rod 432, the actuator 821 can move the second cam shaft 806 in a direction generally indicated by the arrow 822 to move the rocker arm 808 closer to the first cam shaft 410. To decrease a volume of the reagent pumped by each stroke of the rod 432, the actuator 821 can move the second cam shaft 806 in a direction generally indicated by the arrow 824 to move the rocker arm 808 farther from the first cam shaft 410. Put another way, the actuator 821 can be used to control a height of the second cam shaft 806 to control a volume of reagent pumped through the reagent cartridge 404. Thus, in an example, the actuator 821 can adjust the height of the second cam shaft 806 while the second cam shaft 806 is rotating to dynamically control a volume of the reagent pumped.

FIG. 10 illustrates a lowered position (second position) of the lobe 810 of the second cam shaft 806. In the lowered position, an axis 826 of the shaft 416 that extends through the lobes 810 is spaced closer to the tapered surface 818 of the rocker arm 508. Thus, as a result, when the first cam shaft 410 rotates, the first cam shaft 410 is spaced from the rocker arm 808 as shown and is unable to actuate the rod 432 between the first and second positions.

In some examples, the first and second cam shafts 410, 806 are adapted to actuate the rods 432 associated with linear peristaltic pumps. For example, the first and second cam shafts 410, 806 can be arranged to interface with rocker arms 808 coupled to the rods 432 disposed over the chambers 451 of two or more of the groups 606, 608, 610, 612, 614 of FIG. 6. Thus, in this example, the second cam shaft 806 is rotatable to move the rocker arms 808 into and out of engagement with the first cam shaft 410. As the first cam shaft 410 rotates and based on the relative position of the rocker arms 808, the linear peristaltic pumps associated with the chambers 451 of one or more of the groups 606, 608, 610, 612 and/or 614 is actuated. Additionally, by allowing for engagement and disengagement between different ones of the rocker arms 808 and the first cam shaft 410, a flow rate and/or a flow volume (e.g., a pump receipt) flowing through the associated reagent cartridge is dynamically adjustable. In some such arrangements, axes 826, 828 of the cam shafts 410, 806 are substantially parallel to the chambers 451 of the respective groups 606, 608, 610, 612, 614 of the chambers 451. In other such arrangements, the axes 826, 828 of the cam shafts 410, 806 are substantially perpendicular to the chambers 451 of the respective groups 606, 608, 610, 612, 614. As set forth herein, substantially perpendicular accounts for manufacturing tolerances and/or means +/−5° of parallel including being parallel itself.

While FIGS. 8-10 describe a first cam shaft 410 that selectively engages the rocker arm 808 based on the rotational position of the second cam shaft 806, other arrangements are possible. For example, an indexable cam shaft assembly can be provided that includes a plurality of cam shafts in place of the single cam shaft 410. Such an arrangement allows the associated pump drive assembly to change a "pump receipt" by a choosing one of the cam shafts over another one of the cam shafts.

Figure 11:
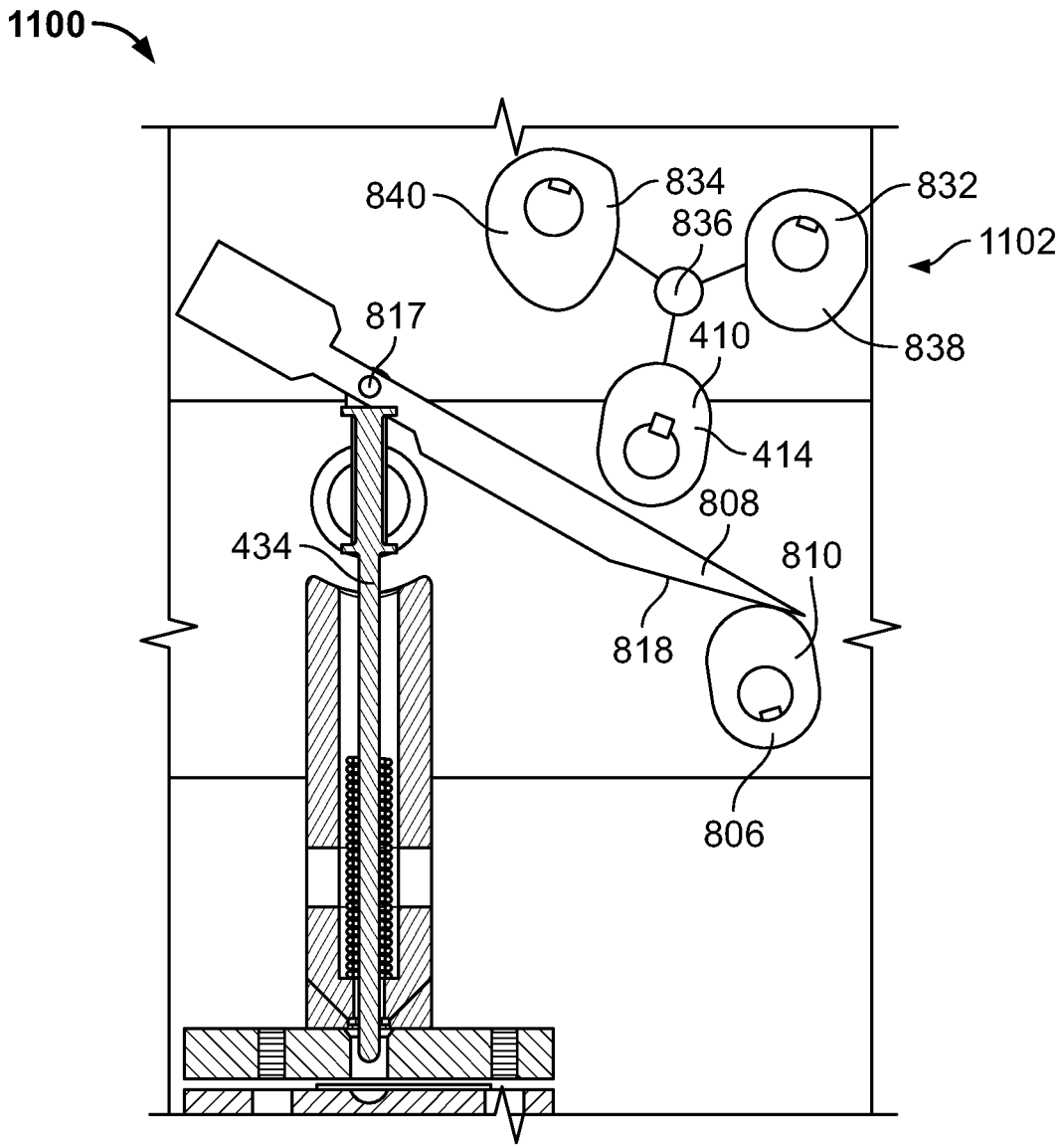
FIG. 11 illustrates a detailed cross-sectional view of another example peristaltic pump that can be used to implement a linear peristaltic pump of FIG. 1 that includes a cam shaft assembly including cam shafts that are selectively indexable into engagement with one or more rocker arms.

One such detailed example of a pump drive assembly 1100 is illustrated in FIG. 11. In the example shown, the pump drive assembly 1100 includes a first cam assembly 1102 including the first cam shaft 410, a third cam shaft 832 and a fourth cam shaft 834. The cam shafts 410, 832, 834 are rotatably coupled to a central shaft 836. The first cam shaft 410 includes the lobes 414, the third cam shaft 832 includes lobes 838 and the fourth cam shaft 834 includes lobes 840. The lobes 414, 838, 840 may be different and/or differently arranged to provide different metering, mixing, flow rates, etc. of the reagent through the associated reagent cartridge. The central shaft 836 is rotatable to index the respective cam shafts 410, 832, 834 into a location that allows one of the cam shafts 410, 832, 834 to engage the rocker arm 808. In some examples, the cam shafts 410, 832, 834 are independently rotatable. In other examples, two or more of the cam shafts 410, 832, 834 are rotatable at the same time. The motor 412 can selectively engage or disengage with one or more of the cam shafts 410, 832, 834, such as via an actuating assembly moving the motor 412 and/or a gear assembly coupled to the motor 412 into engagement with the one or more of the cam shafts 410, 832, 834 to rotate the one or more of the cam shafts 410, 832, 834.

While the actuators disclosed in connection with FIGS. 8-11 include cam shafts to actuate the rods 433, different types of actuators can be used to implement the pump drive assembly 134 of FIG. 1. For example, FIGS. 12 and 13 illustrate piezoelectric actuators being used to actuate the deformable material 459 and FIG. 14 illustrates a pneumatic actuator being used to actuate the deformable material 459.

Figure 12:
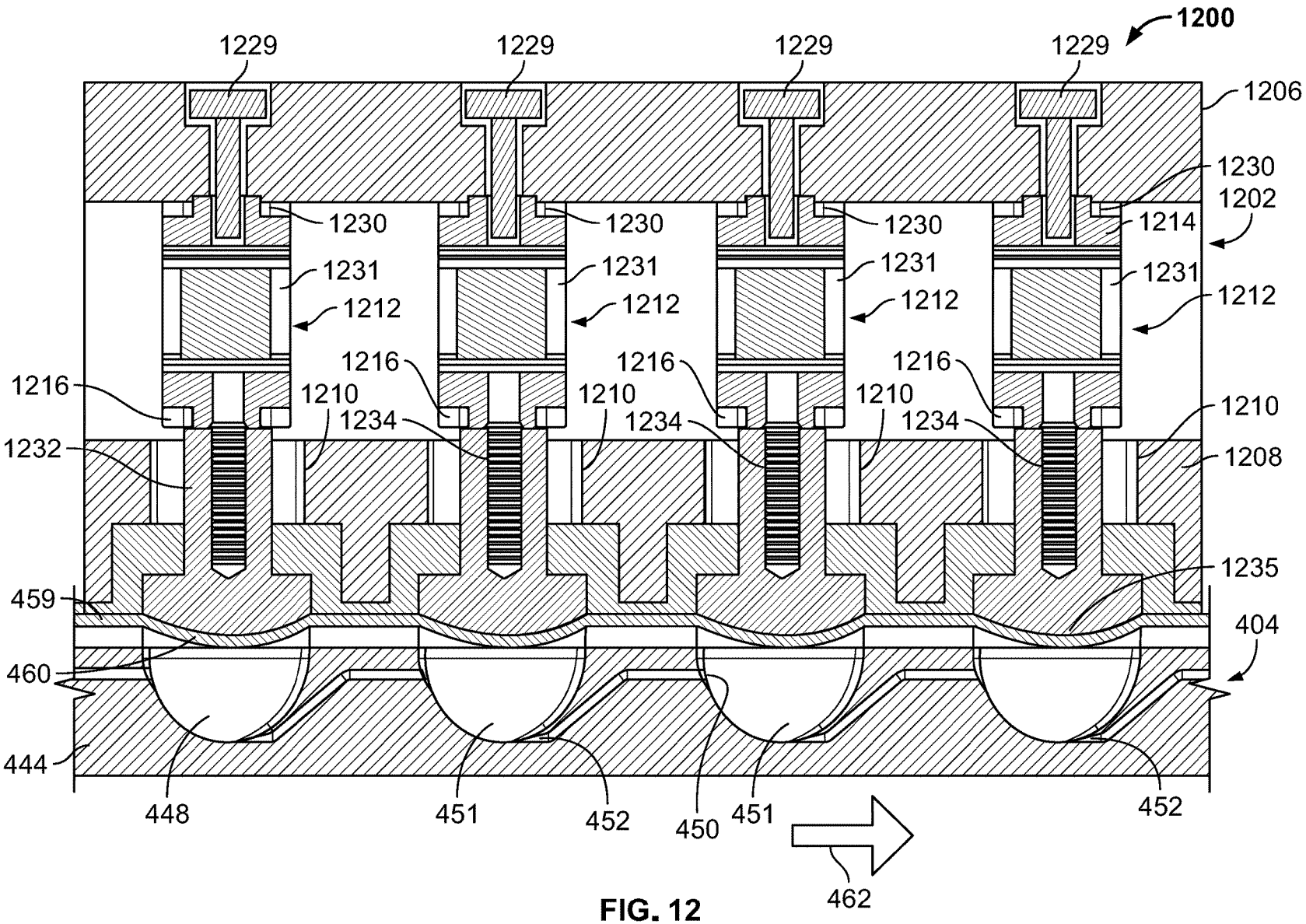
FIG. 12 is a cross-sectional view of another example linear peristaltic pump including a pump drive assembly including piezoelectric actuators that can be used to implement a linear peristaltic pump of the system of FIG. 1.
Figure 13:
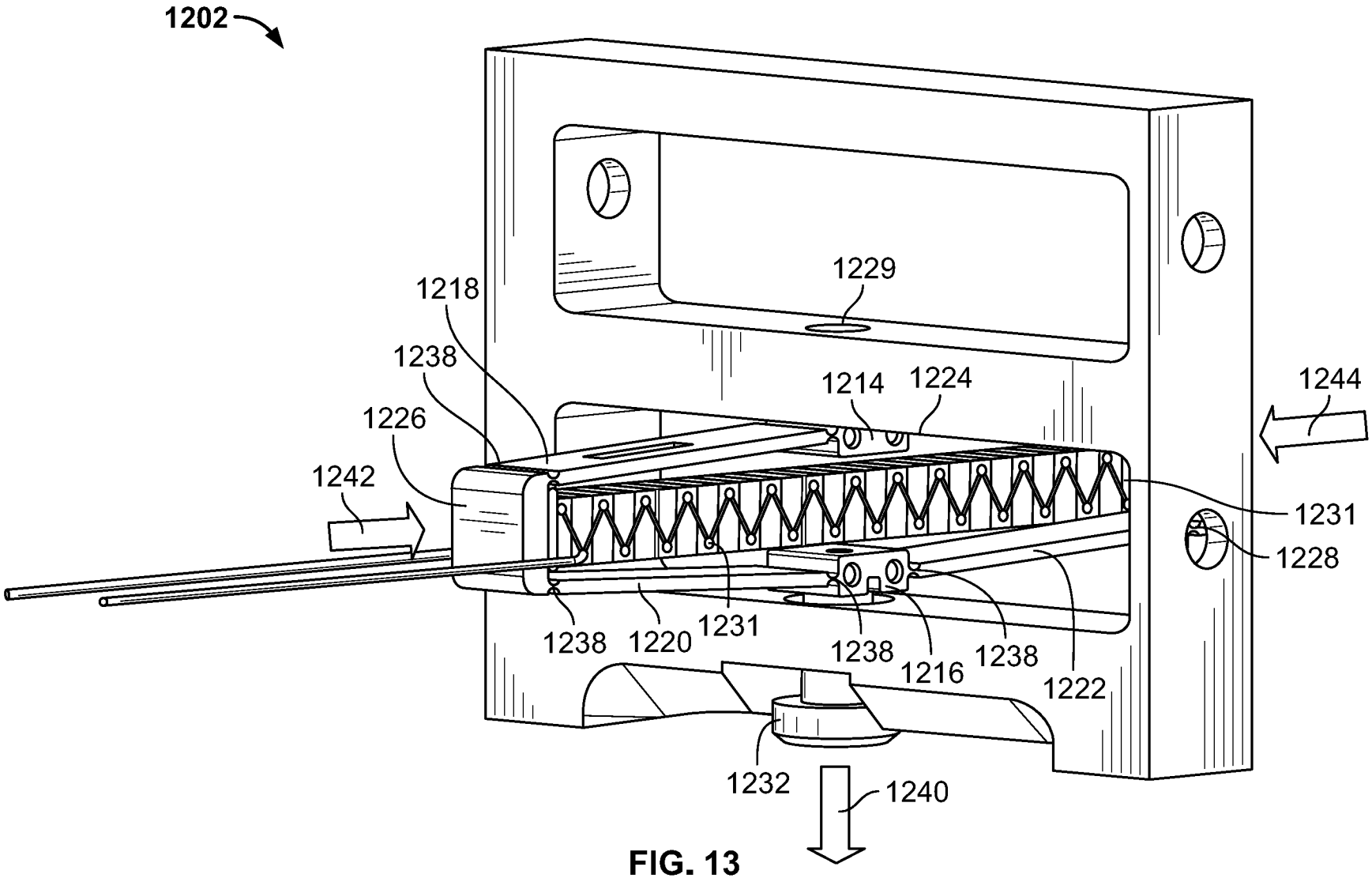
FIG. 13 is an isometric view of a portion of the pump drive assembly of FIG. 12.
Figure 14:
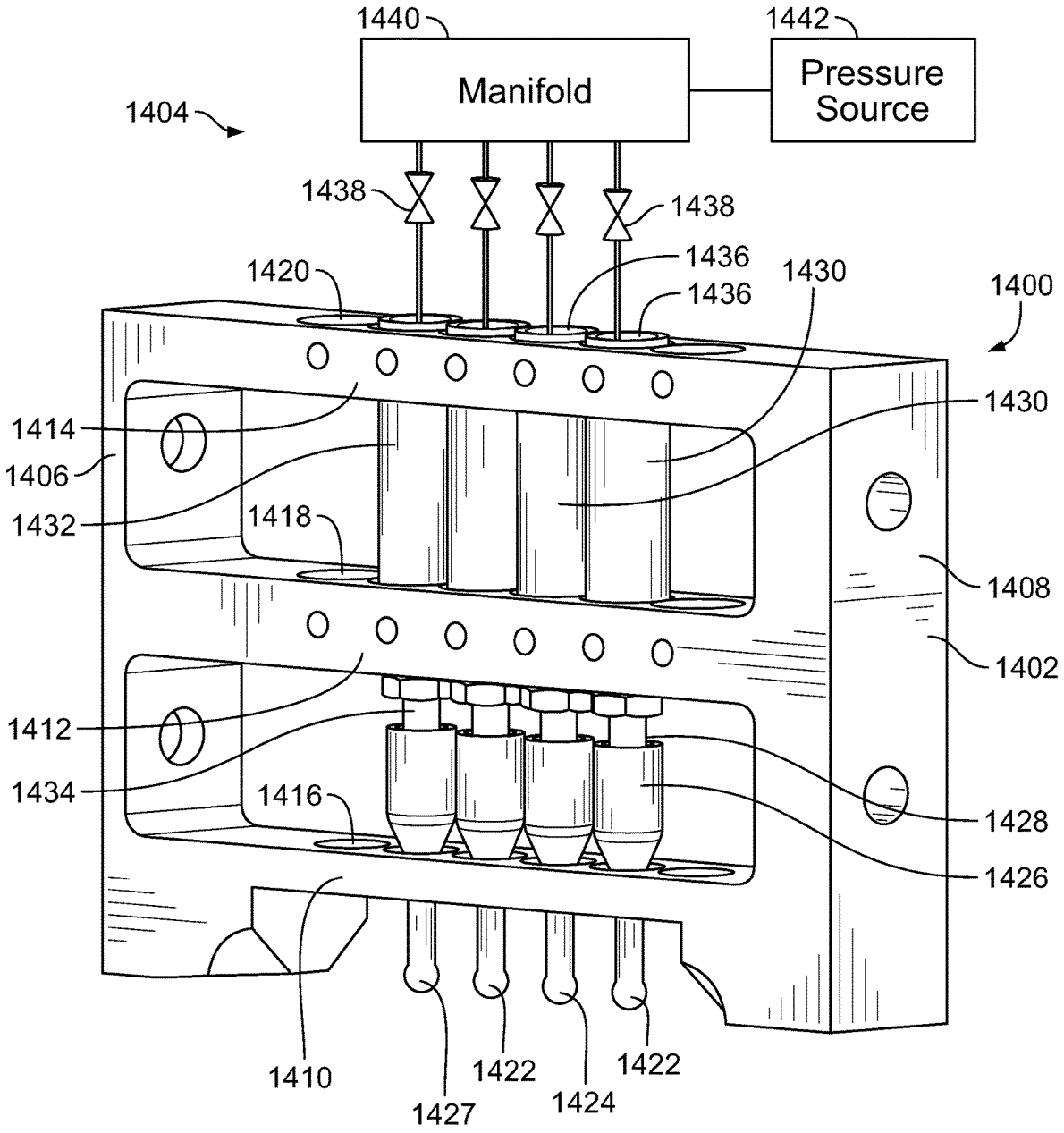
FIG. 14 is an isometric view of a portion of a pump drive assembly including pneumatic actuators that can be used to implement a pump drive assembly of the system of FIG. 1.

Referring first to FIGS. 12 and 13, an example linear peristaltic pump 1200 includes a pump drive assembly 1202 and the reagent cartridge 404. FIG. 13 is an isometric view of a portion of the pump drive assembly 1202 of FIG. 12.

In the example shown, the pump drive assembly 1202 includes a frame 1206. The frame 1206 includes a guide 1208 that defines apertures 1210. The pump drive assembly 1202 also includes piezoelectric actuator assemblies 1212 (the piezoelectric actuator assembly 1212 is most clearly shown in FIG. 13).

Referring to FIG. 13, each of the piezoelectric actuator assemblies 1212 is formed as a scissor jack including a first bracket 1214, a second bracket 1216, and arms 1218, 1220, 1222, 1224. The arms 1218, 1220 and 1222, 1224 are pivotably coupled to one another at ends 1226, 1228 and to the brackets 1214, 1216. The first bracket 1214 is coupled to the frame 1206 via a fastener 1229. The frame 1206 includes a tapered surface 1230 (the tapered surface 1230 is most clearly shown in FIG. 12). The tapered surface 1230 encourages the first bracket 1214 to align with the frame 1206 prior to coupling via the fastener 1229.

A piezoelectric actuator 1231 is disposed in a space defined by the brackets 1214, 1216 and the arms 1218-1224. The actuator 1231 is coupled to and between the ends 1226, 1228. In the example shown in FIG. 13, the piezoelectric actuator 1231 is a piezoelectric block actuator. However, a different piezoelectric actuator can be used instead.

Referring back to FIG. 12, rods 1232 are coupled to the respective second brackets 1216 via threaded fasteners 1234. The rods 1232 include rounded-distal ends 1235 that interface with (depress) the deformable material 459. While the rods 1232 are shown having the rounded-distal ends 1235, the rods 1232 may interface with the deformable material 459 in any suitable way including any of the examples disclosed in connection with FIGS. 15-20.

The rods 1232 are selectively actuatable between a retracted position (a first position) and an extended position (a second position), via the actuators 1231. In the example shown, the rods 1232 are in a partially extended position and the portions 460 of the deformable material 459 are disposed within a dimensional envelope of the depressions 448.

To flow reagent in a direction generally indicated by arrow 462, in some example, the actuators 1231 sequentially move the respective rods 1232 between the extended position and the retracted position. As the deformable material 459 is actuated, reagent is pumped out of the current chamber 451 through the outlet 452 and into a subsequent, downstream chamber 451, thereby sequentially moving the reagent through the chambers 451 in the direction generally indicated by arrow 462. The rods 1232 may remain in the extended position to deter backflow by blocking a respective inlet 450 and to urge the reagent to flow in the direction generally indicated by the arrow 462.

Referring back to FIG. 13, the piezoelectric actuator assembly 1212 includes living hinges 1238. The living hinges 1238 pivotably couple the brackets 1214, 1216, the arms 1218-1224, and the ends 1226, 1228 and form a scissor jack. In the example shown, the first arm 1218 is hingeably coupled between the first bracket 1214 and the first end 1226 and the second arm 1220 is hingeably coupled between the first end 1226 and the second bracket 1216. Additionally, the third arm 1222 is hingeably coupled between the second bracket 1216 and the second end 1228 and the fourth arm 1224 is hingeably coupled between the second end 1228 and the first bracket 1214. To extend the rod 1232 in a direction generally indicated by arrow 1240, the actuator 1231 is moved (contracts) in a direction generally indicated by arrows 1242, 1244. To retract the rod 1232 in a direction generally opposite that indicated by the arrow 1240, the actuator 1231 is moved (expands) in a direction generally opposite that indicated by arrows 1242, 1244. In other implementations, the living hinges 1238 can be pin hinges. In some implementations, the piezoelectric actuator 1231 can be vertically mounted to directly move the rods 1232 up and/or down relative to the frame 1206 such that the arms 1218-1224 can be eliminated.

FIG. 14 is an isometric view of a portion of another pump drive assembly 1400 in accordance with the teachings of this disclosure. The pump drive assembly 1400 may be used to implement the pump drive assembly 134 of the system 100 of FIG. 1. In the example shown, the pump drive assembly 1400 includes a guide 1402 and an actuator 1404. The guide 1402 includes first and second lateral walls 1406, 1408 and first, second and third transverse sections 1410, 1412, 1414. The transverse sections 1410-1414 extend between and are coupled to the lateral walls 1406, 1408. Apertures 1416, 1418, 1420 are defined by the transverse sections 1410-1414.

The actuator 1404 includes rods 1422 disposed within the apertures 1416 of the first transverse section 1410. The rods 1422 include a first portion 1424 and a second portion 1426. The first portion 1424 includes a bulbous distal end 1427 and the second portion 1426 includes a receptacle (blind bore) 1428.

The actuator 1404 also includes single-acting air cylinders 1430. Alternatively, double-acting air cylinders may be used. The cylinders 1430 are disposed within the apertures 1418, 1420 of the second and third transverse sections 1412, 1414. The cylinders 1430 include a body 1432, return springs (not shown), rods 1434, and inlet ports 1436. The rods 1434 are movably coupled within the bodies 1432 of the cylinders 1430 between a retracted position and an extended position. The return springs bias the rods 1434 toward the retracted position in some implementations. In other implementations, the return springs bias the rods 1434 toward the extended position. The rods 1434 are received within and are coupled within the receptacles 1428 of the rods 1422. The couplings provided between the rods 1422, 1434 may be a threaded coupling, an interference fit, etc.

The actuator 1404 also includes valves 1438 and a manifold 1440 coupled to a pressure source 1442. The pressure source 1142 may be provided by the system of FIG. 1, for example. To selectively flow a fluid, such as a gas (air), to the cylinders 1430, the valves 1438 are actuatable between an open position and a closed position. When one of the valves 1438 is in the open position, gas flows to the corresponding cylinder 1430, overcomes a force of the return spring and extends the bulbous distal ends 1427 to engage and move the deformable material 459, for example. When one of the valves 1438 is in the closed position, gas does not flow to the corresponding cylinder 1430 and the return spring returns the rod 1434 and the bulbous distal end 1427 of the rod 1422 to the retracted position, for example.

Figure 16:
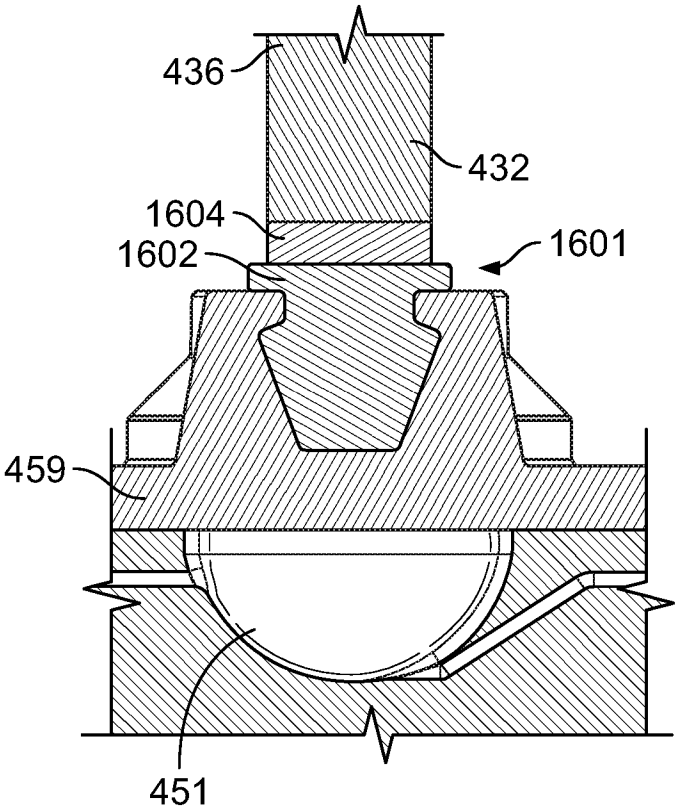
FIG. 16 illustrates a cross-sectional view of another example interface between a deformable material and one of the rods of a pump drive assembly.
Figure 15:
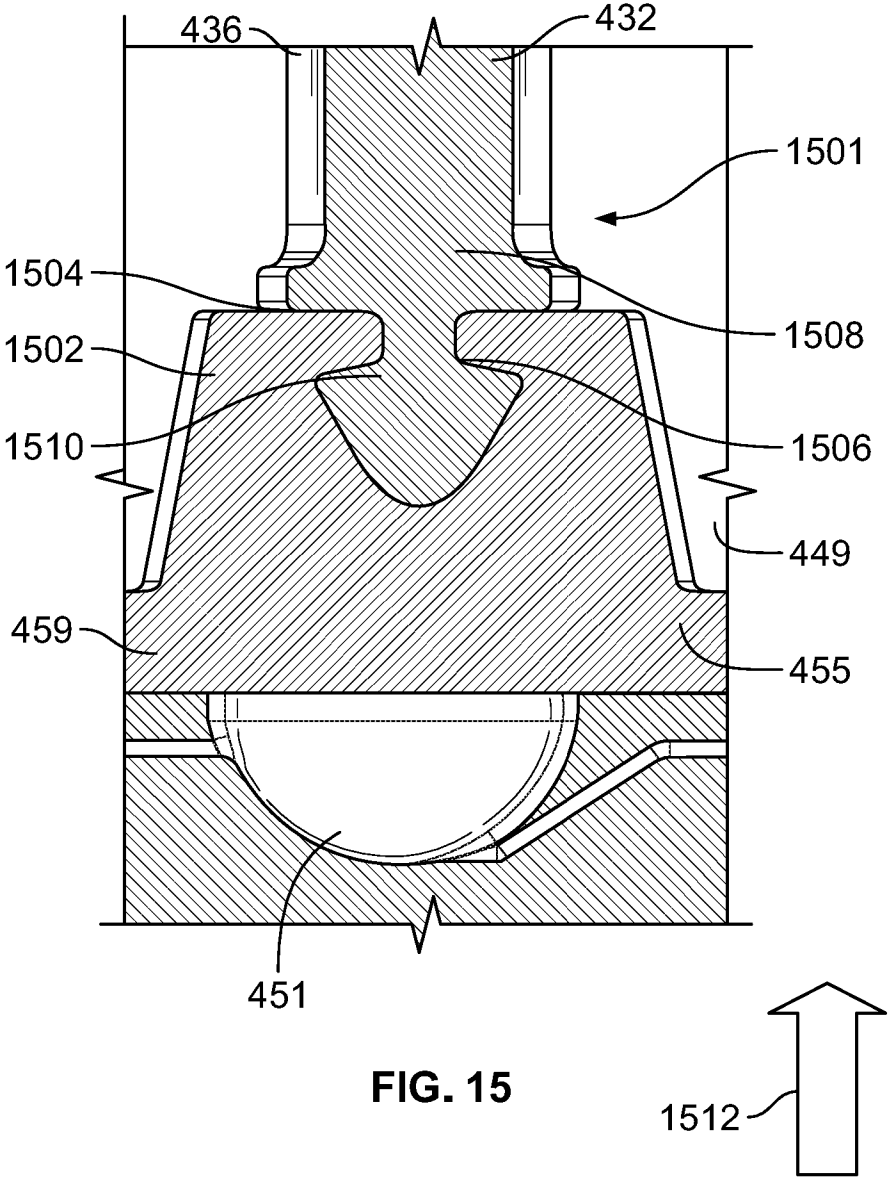
FIG. 15 illustrates a cross-sectional view of an alternative example interface between a deformable material and one of the rods of a pump drive assembly.
Figure 17:
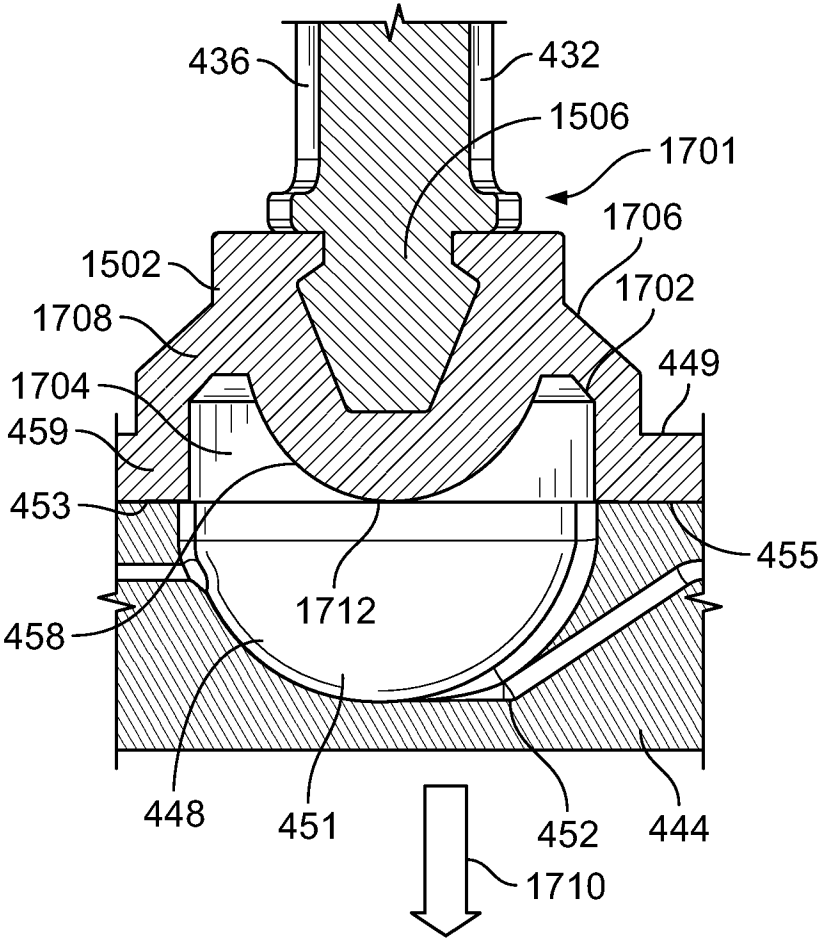
FIG. 17 illustrates a cross-sectional view of another example interface between a deformable material and one of the rods of a pump drive assembly.

While the examples disclosed above illustrate the first and second surfaces 455, 449 of the deformable material 459 being substantially parallel to one other, the deformable material 459 can be formed to provide a mechanical connection between the rod and the deformable material 459 as shown in FIGS. 15-17 and/or to provide a membrane switch above the depression 448 as shown in FIGS. 17-20.

FIG. 15 illustrates a cross-sectional view of one such example interface 1501 that provides a mechanical connection between the deformable material 459 and one of the rods 432. In the example shown, the second surface 449 of the deformable material 459 includes a protrusion 1502. The protrusion 1502 includes a female portion 1504 that covers the chamber 451. In an example, the protrusion 1502 has a substantially circular cross-section. The female portion 1504 is formed by a blind bore having a concave quadrilateral cross-section (arrow-shaped) having rounded corners.

The second portion 436 of the rod 432 includes a male portion 1506. The male portion 1506 has a cross-section corresponding to the cross-section of the female portion 1504. An entrance 1508 of the female portion 1504 is tapered and an end 1510 of the male portion 1506 is rounded. When the end 1510 of the male portion 1506 engages the entrance 1508 of the female portion 1504, the corresponding contours of the entrance 1508 and the end 1510 encourage alignment and for the snap-fit (mechanical) connection between the rod 432 and the deformable material 459 to be formed. Thus, with this mechanical connection and when the rod 432 retracts in a direction generally indicated by arrow 1512, the snap-fit connection between the deformable material 459 and the rod 432 pulls the deformable material 459 in the direction generally indicated by the arrow 1512.

FIG. 16 illustrates a cross-sectional view of another example interface 1601 between the deformable material 459 and one of the rods 432. Elements of the interface 1601 which are the same or similar to the interface 1501 are designated by the same reference numeral.

In contrast to the interface 1501 of FIG. 15, a first magnet 1602 is received within the female portion 1504. The first magnet 1602 has a corresponding shape to the blind bore of the female portion 1504. Thus, a snap-fit connection is formed when the first magnet 1602 is received within the female portion 1504.

A distal end of the second portion 436 of the rod 432 carries a second magnet 1604. The first magnet 1602 is attracted to the second magnet 1604 to couple the rod 432 and the deformable material 459 together. As an alternative, one of the first magnet 1602 or the second magnet 1604 can be a magnet and the other can include a material (a ferromagnetic material) that is attracted to the magnet.

FIG. 17 illustrates a cross-sectional view of another example interface 1701 between the deformable material 459 and one of the rods 432. Elements of the interface 1701 which are the same or similar to the interface 1501 of FIG. 15 are designated by the same reference numeral. A description of these elements is abbreviated or eliminated in the interest of brevity.

In contrast to the interface 1501 of FIG. 15, the first portion 453 of the first surface 455 of the deformable material 459 is not co-planar with at least a portion of the second portion 458 of the first surface 455 of the deformable material 459. Instead, the second portion 458 includes an inner wall 1702 that defines a portion 1704 of the chamber 451. Additionally, the inner wall 1702 and an oppositely positioned portion 1706 of the second surface 449 of the deformable material 459 form a membrane switch 1708. In an example, when the rod 432 moves in a direction generally indicated by arrow 1710, the membrane switch 1708 allows the second portion 458 of the first surface 455 of the deformable material 459 to be further received within the depression 448 formed by the body 444 as compared to when the first surface 455 is substantially flat as illustrated in the examples disclosed above. As a result, an apex 1712 of the second portion 458 can be seated against the outlet 452 of the chamber 451 when the rod 432 is in the extended position to deter reagent from entering the chamber 451 via the outlet 452 (e.g., deter backwash flow), for example, without substantially stretching the deformable material 459.

Figure 18:
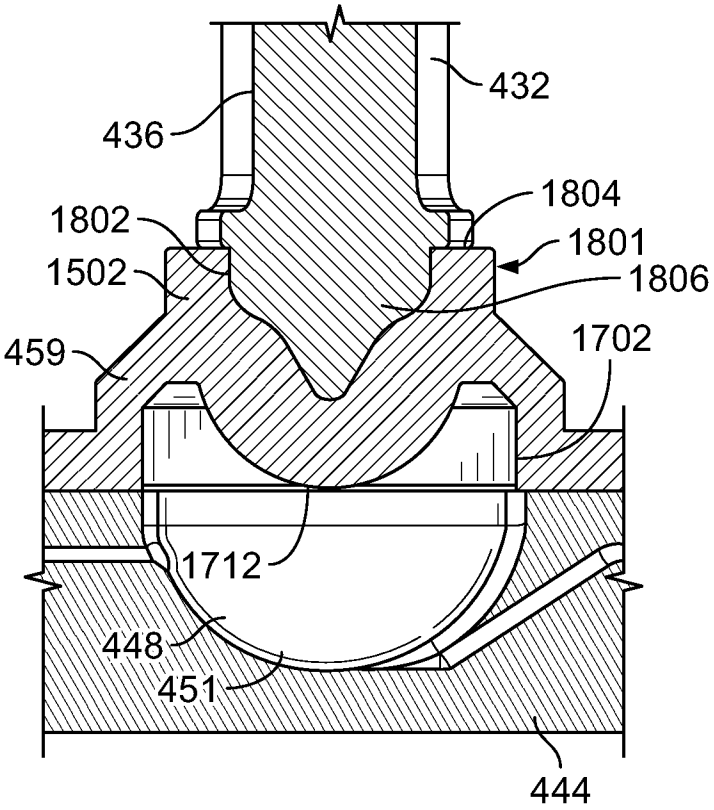
FIG. 18 illustrates a cross-sectional view of another example interface between a deformable material and one of the rods of a pump drive assembly.

FIG. 18 illustrates a cross-sectional view of another example interface 1801 between the deformable material 459 and one of the rods 432. Elements of the interface 1801 which are the same or similar to the interface 1701 of FIG. 17 are designated by the same reference numeral. A description of these elements is abbreviated or eliminated in the interest of brevity.

In contrast to the interface 1701 of FIG. 17, a snap-fit connection is not formed between the rod 432 and the deformable material 459. Instead, the protrusion 1502 of the deformable material 459 includes a female portion 1802 having an entrance 1804 that has a diameter that is wider or has a similar width to the remainder of the female portion 1802. Thus, the female portion 1802 does not include a snapping feature that locks into engagement with corresponding structures on the rod 432 as the examples disclosed above. The rod 432 includes a male portion 1806 that has a shape (taper) that corresponds to the female portion 1802.

Figure 19:
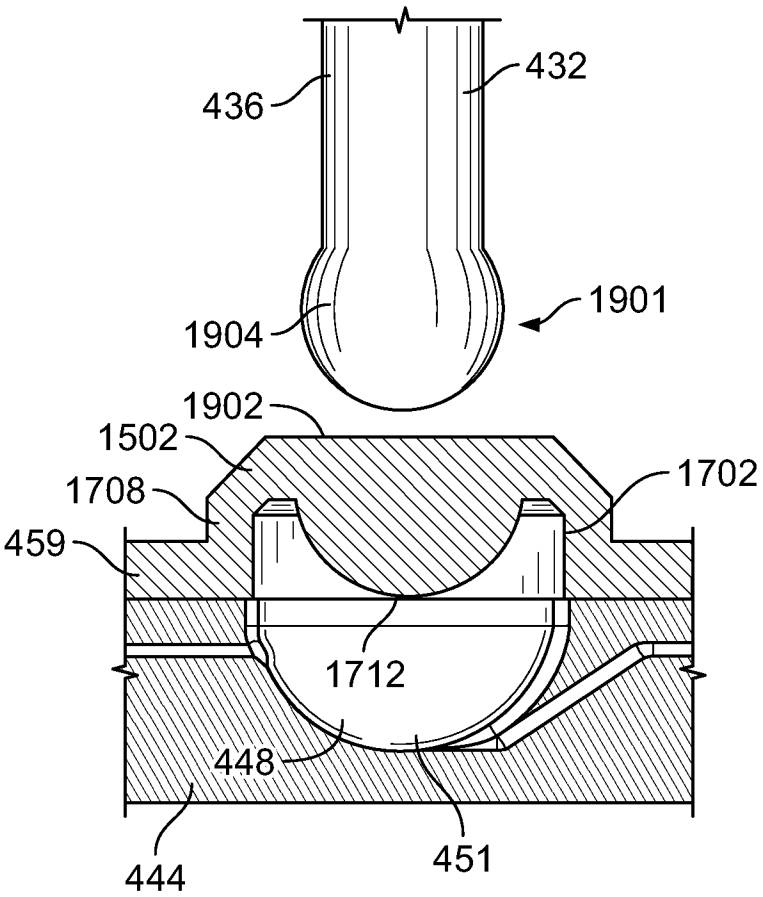
FIG. 19 illustrates a cross-sectional view of another example interface between the deformable material and one of the rods of a pump drive assembly.

FIG. 19 illustrates a cross-sectional view of another example interface 1901 between the deformable material 459 and one of the rods 432. Elements of the interface 1901 which are the same or similar to the interface 1801 of FIG. 18 are designated by the same reference numeral. A description of these elements is abbreviated or eliminated in the interest of brevity.

In contrast to the interface 1801 of FIG. 18, the protrusion 1502 of the deformable material 459 of FIG. 19 includes a substantially flat surface 1902 and a distal end 1904 of the rod 432 is bulbous shaped. To actuate the deformable material 459 between, for example, a first position in which the deformable material 459 does not extend into a dimensional envelope of the body 444 and a second position in which the deformable material 459 extends into the dimensional envelope of the body 444, the distal end 1904 is adapted to engage the flat surface 1902 of the deformable material 459.

Figure 20:
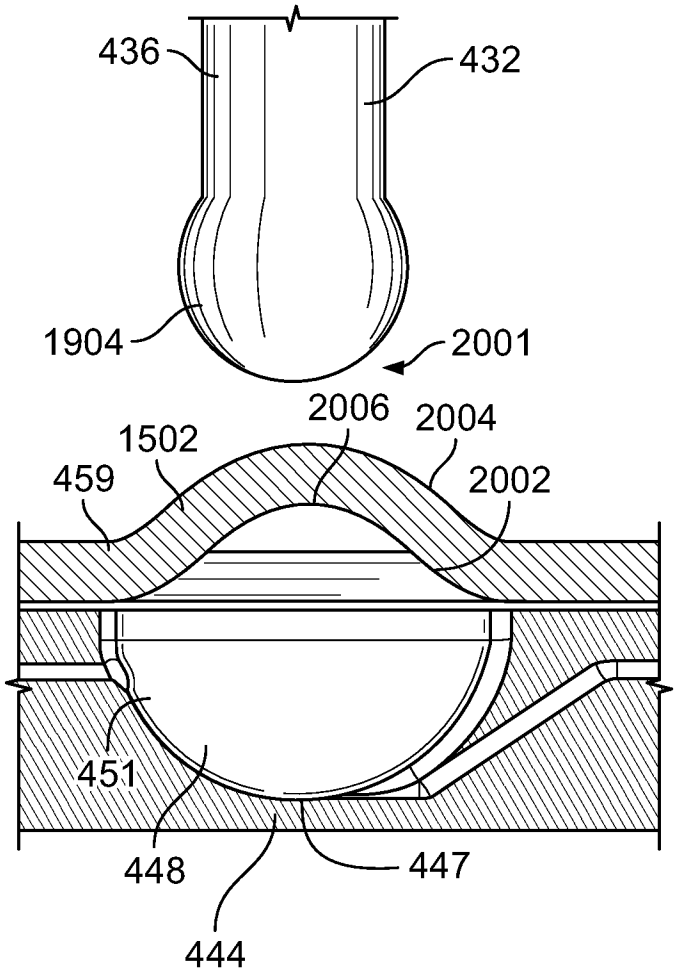
FIG. 20 illustrates a cross-sectional view of another example interface between a deformable material and one of the rods of a pump drive assembly.

FIG. 20 illustrates a cross-sectional view of another example interface 2001 between the deformable material 459 and one of the rods 432. Elements of the interface 2001 which are the same or similar to the interface 1901 of FIG. 19 are designated by the same reference numeral. A description of these elements is abbreviated or eliminated in the interest of brevity.

In contrast to the interface 1901 of FIG. 19, the protrusion 1502 of the deformable material 459 of FIG. 20 includes interior facing and exterior facing concave surfaces 2002, 2004. In the example shown, the interior facing concave surface 2002 opposes the depression 448 defined by the body 444 such that an apex 2006 of the interior facing concave surface 2002 opposes the apex 447 of the depression 448.

Figure 21:
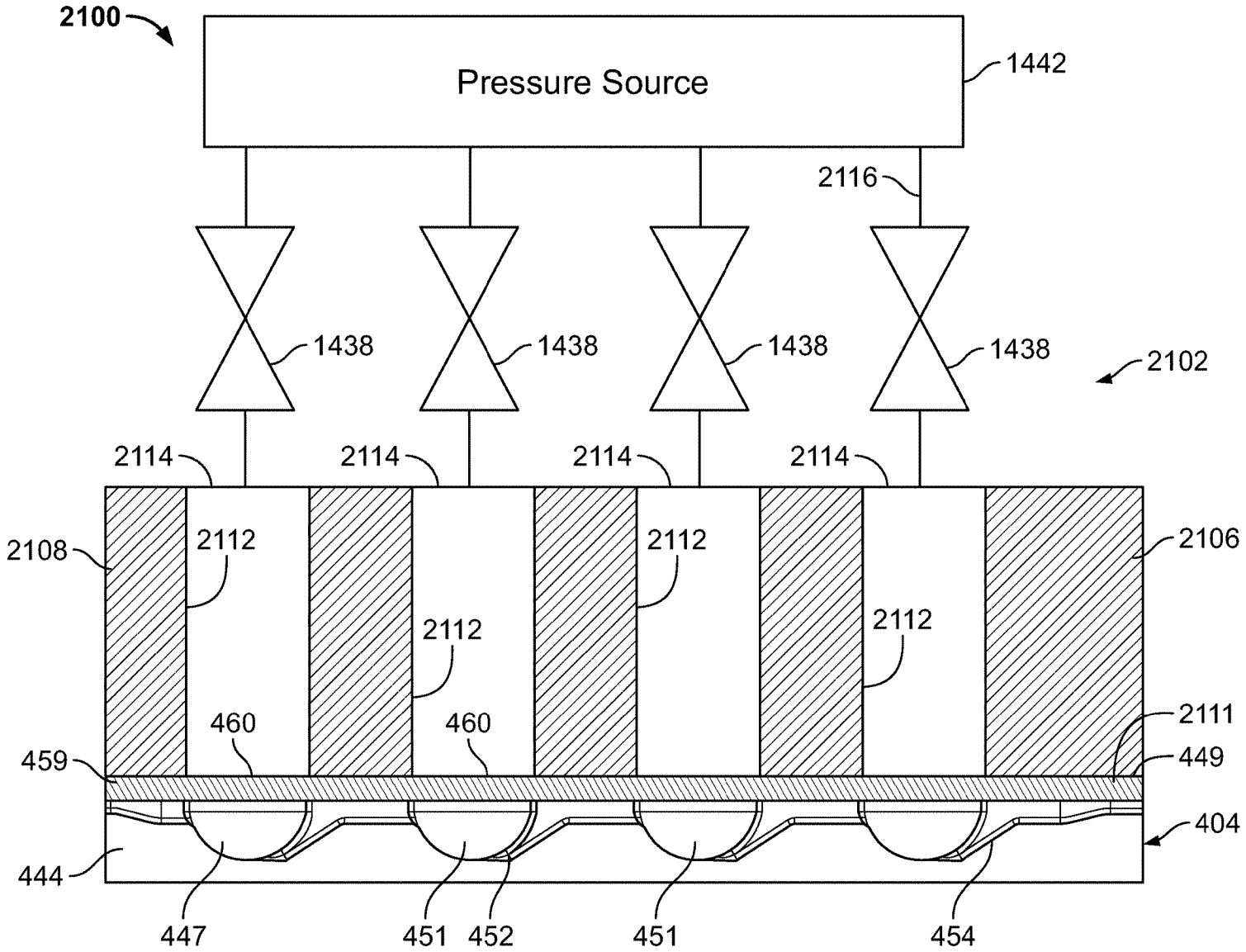
FIG. 21 is a cross-sectional view of another example linear peristaltic pump that can be used to implement a linear peristaltic pump of the system of FIG. 1.

FIG. 21 is a cross-sectional view of an example linear peristaltic pump 2100 in accordance with the teaching of this disclosure. The linear peristaltic pump 2100 may be used to implement the linear peristaltic pump 136 of the system 100 of FIG. 1. The linear peristaltic pump 2100 includes a pump drive assembly 2102 and the reagent cartridge 404.

In the example shown, the pump drive assembly 2102 includes a manifold 2106 and the valves 1438. The manifold 2106 includes a body 2108 including a mating surface 2111. The mating surface 2111 sealingly engages the second surface 449 of the deformable material 459.

The body 2108 of the manifold 2106 also includes apertures 2112 and inlet ports 2114. Fluidic lines 2116 fluidly couple the inlet ports 2114, the valves 1438, and the pressure source 1442. In some examples, the manifold 2106 is carried by and/or integrated with the reagent cartridge 2104. In such examples, the manifold 2106 is adapted to interface with (sealingly engage) components of the system 100. In other examples, the manifold 2106 is carried by and/or integrated with the system 100. In such examples, the deformable material 459 is adapted to interface with (sealingly engage) the deformable material 459.

To selectively actuate the deformable material 459 to the extended position, one or more of the valves 2138 are opened and pressure is increased within the corresponding apertures 2112. The pressure overcomes a biasing force of the deformable material 459 and the portion 460 of the deformable material 459 is moved (displaced) within the dimensional envelope of the body 444 of the reagent cartridge 404. To selectively actuate the deformable material 459 to the retracted (stable) position, as shown, pressure within the corresponding apertures 2112 is decreased (e.g., vented) and the biasing force of the deformable material 459 overcomes the force applied by the pressure within the aperture 2112. Alternatively, the pressure source 2142 may generate a negative pressure within the aperture 2112 to draw the deformable material 459 toward the retracted position.

Figure 22:
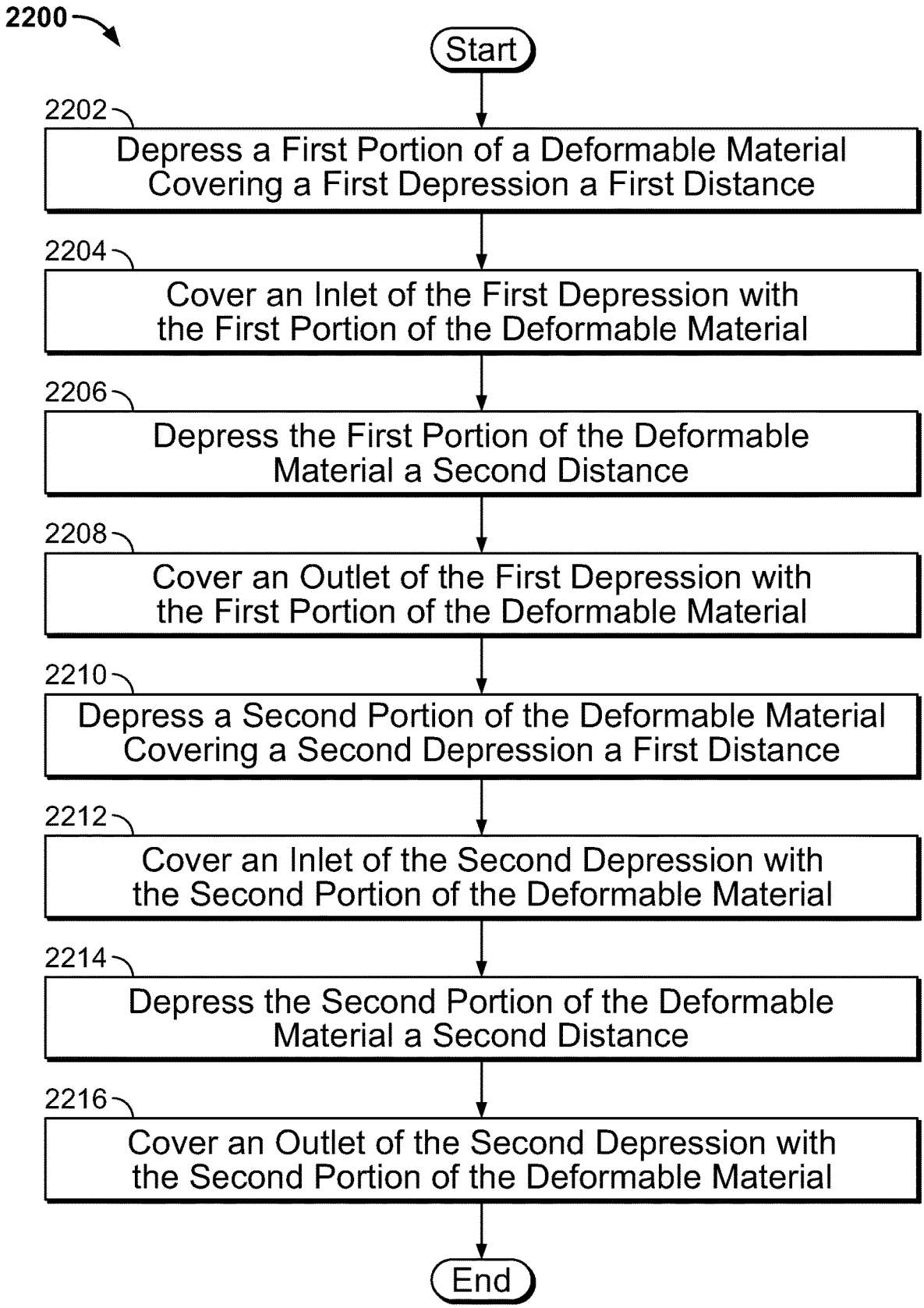
FIG. 22 illustrates a flowchart for performing a method of pumping fluid through a reagent cartridge using the system of FIG. 1.

FIG. 22 illustrates a flowchart for performing a method of pumping fluid through a reagent cartridge 102 using the system 100 of FIG. 1. A process 2200 begins at block 2202 by depressing a first portion 460 of the deformable material 459 covering a first depression 448 a first distance. In an example, the one or more processors 142 executing instructions stored in the memory 144 cause the pump drive assembly 134 to depress the portion 460 of the deformable material 459 covering a first one of the depressions 448 a first distance. At block 2204, the inlet 450 of the first depression 448 is covered by the first portion 460 of the deformable material 459. The first portion 460 of the deformable material 459 covering the first depression 448 is depressed a second distance (block 2206). In an example, the one or more processors 142 executing instructions stored in the memory 144 cause the pump drive assembly 134 to depress the portion 460 of the deformable material 459 covering the first one of the depressions 448 a second distance. At block 2208, the outlet 452 of the first depression 448 is covered by the first portion 460 of the deformable material 459.

The process 2200 continues at block 2210 by depressing a second portion 460 of the deformable material 459 covering a second depression 448 a first distance. In an example, the one or more processors 142 executing instructions stored in the memory 144 cause the pump drive assembly 134 to depress the portion 460 of the deformable material 459 covering a second one of the depressions 448 a first distance. The first and second depressions 448 may be immediately adjacent to one other where, for example, the first depression is the first depression in a row of four depressions and the second depression is the second depression in the row of four depressions. At block 2212, the inlet 450 of the second depression 448 is covered by the second portion 460 of the deformable material 459. The second portion 460 of the deformable material 459 covering the second depression 448 is depressed a second distance (block 2214). In an example, the one or more processors 142 executing instructions stored in the memory 144 cause the pump drive assembly 134 to depress the portion 460 of the deformable material 459 covering a second one of the depressions 448 a second distance. At block 2216, the outlet 452 of the second depression 448 is covered by the second portion 460 of the deformable material 459.

Figure 23:
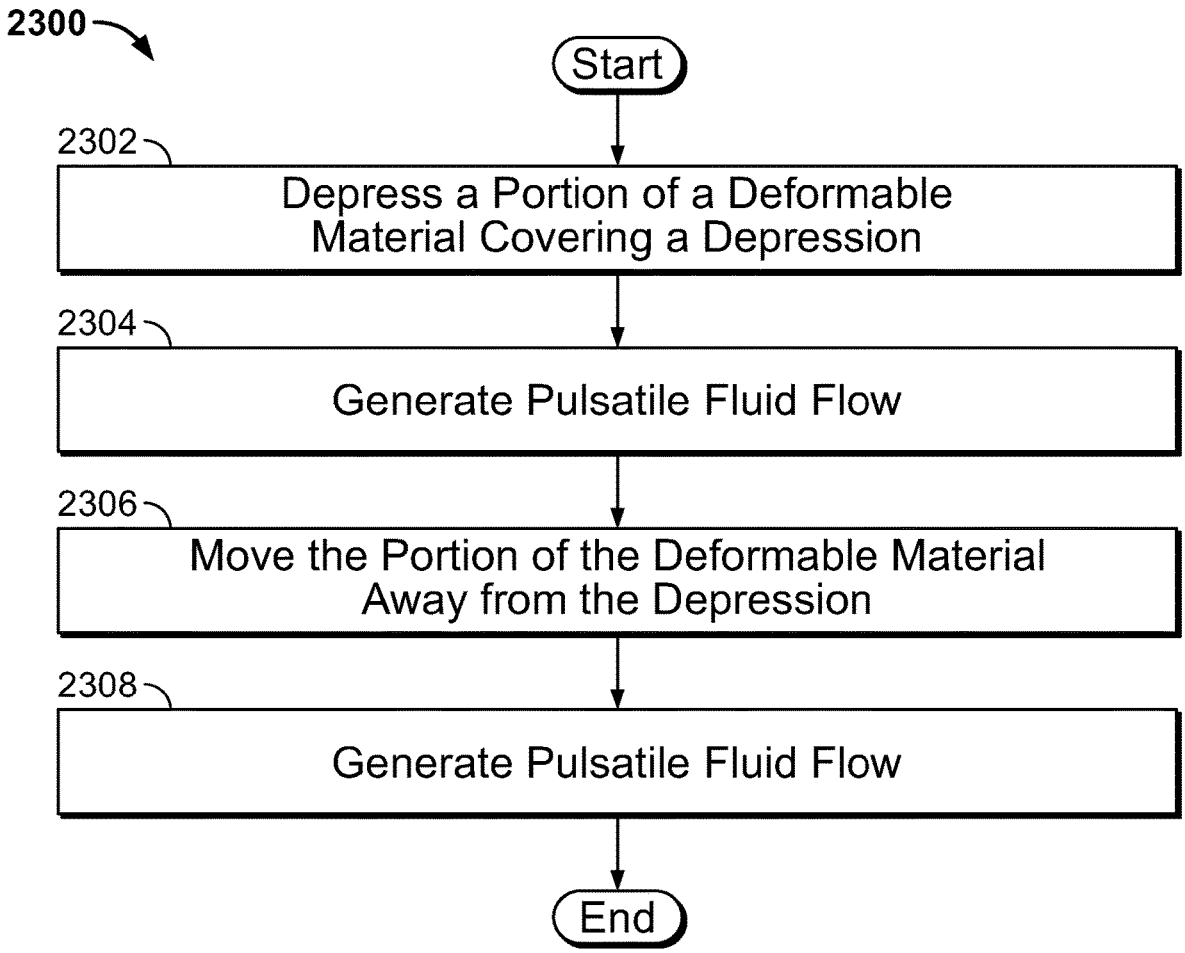
FIG. 23 illustrates a flowchart for performing a method of generating a pulsatile flow through the cartridge using the system of FIG. 1.

FIG. 23 illustrates a flowchart for performing a method of generating a pulsatile flow through the reagent cartridge 102 using the system 100 of FIG. 1. A process 2300 begins at block 2302 by depressing a portion 460 of the deformable material 459 covering a depression 448. In an example, the one or more processors 142 executing instructions stored in the memory 144 cause the pump drive assembly 134 to depress the portion 460 of the deformable material 459. At block 2304, a pulsatile fluid flow is generated. In an example, the one or more processors 142 executing instructions stored in the memory 144 cause the linear peristaltic pump 136 to generate the pulsatile fluid flow. In some examples, the pulsatile fluid flow is generated in response to depressing the portion 460 of the deformable material 459.

The portion 460 of the deformable material 459 covering the depression 448 is moved away from the depression 448 (block 2306). In an example, the one or more processors 142 executing instructions stored in the memory 144 cause the pump drive assembly 134 to allow the portion 460 of the deformable material 459 to move away from the depression 448. At block 2308, a pulsatile fluid flow is generated. In an example, the one or more processors 142 executing instructions stored in the memory 144 cause the linear peristaltic pump 136 to generate the pulsatile fluid flow. In some examples, the pulsatile fluid flow is generated in response to releasing and/or moving the portion 460 of the deformable material 459 outside of the dimensional envelope of the depression 448.

Figure 24:
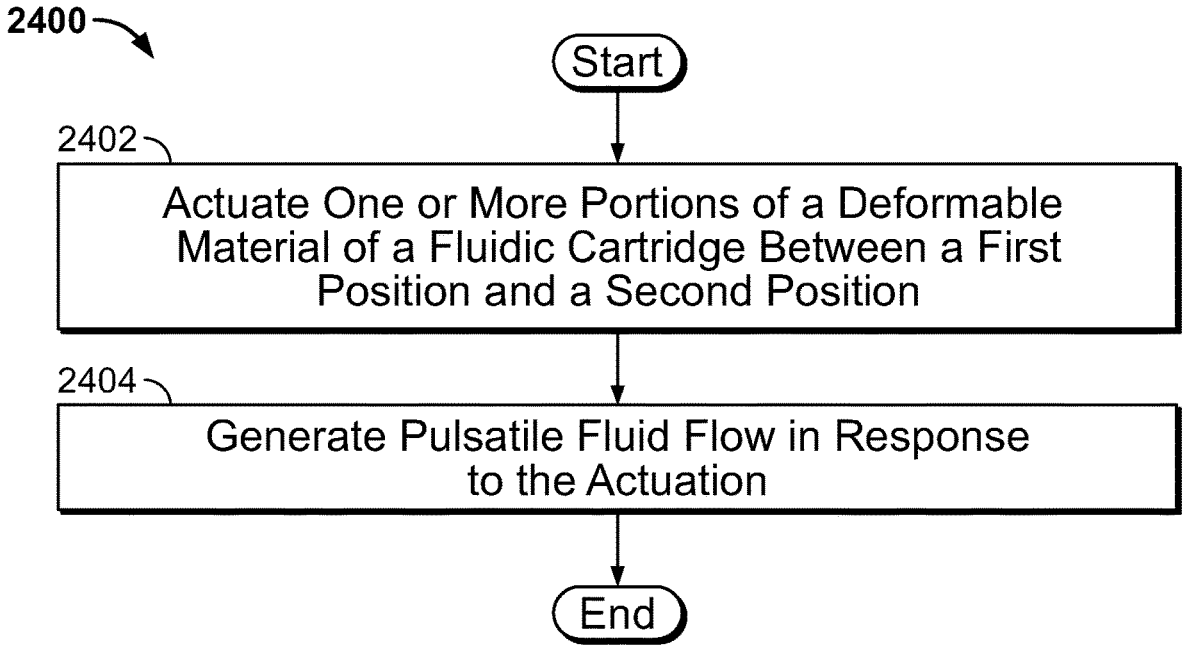
FIG. 24 illustrates a flowchart for performing a method of generating a pulsatile flow through the cartridge using the system of FIG. 1.

FIG. 24 illustrates a flowchart for performing a method of generating a pulsatile flow through the cartridge 102 using the system 100 of FIG. 1. A process 2400 begins at block 2402 with actuating one or more portions 460 of a deformable material 459 of the fluidic cartridge 102 between a first position and a second position. In an example, the one or more processors 142 executing instructions stored in the memory 144 cause the pump drive assembly 134 to move or otherwise allow the portion 460 of the deformable material 459 to move between a first position and a second position relative to the depression 448. Each portion 460 covers a depression 448 to define a chamber 451 and forms a portion of the linear peristaltic pump 136. At block 2404, the process 2400 includes generating a pulsatile fluid flow through the fluidic cartridge 102 in response to the actuation. In an example, the one or more processors 142 executing instructions stored in the memory 144 cause the linear peristaltic pump 136 to generate the pulsatile fluid flow in response to actuating the deformable material 459.

With reference to the flowcharts illustrated in FIGS. 22, 23, and 24, the order of execution of the blocks may be changed, and/or some of the blocks described may be changed, eliminated, combined and/or subdivided into multiple blocks.

The foregoing description is provided to enable a person skilled in the art to practice the various configurations described herein. While the subject technology has been particularly described with reference to the various figures and configurations, it should be understood that these are for illustration purposes only and should not be taken as limiting the scope of the subject technology.

As used herein, an element or step recited in the singular and proceeded with the word "a" or "an" should be understood as not excluding plural of said elements or steps, unless such exclusion is explicitly stated. Furthermore, references to "one implementation" are not intended to be interpreted as excluding the existence of additional implementations that also incorporate the recited features. Moreover, unless explicitly stated to the contrary, implementations "comprising," "including," or "having" an element or a plurality of elements having a particular property may include additional elements whether or not they have that property. Moreover, the terms "comprising," including," having," or the like are interchangeably used herein.

The terms "substantially" and "about" used throughout this Specification are used to describe and account for small fluctuations, such as due to variations in processing. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

There may be many other ways to implement the subject technology. Various functions and elements described herein may be partitioned differently from those shown without departing from the scope of the subject technology. Various modifications to these implementations may be readily apparent to those skilled in the art, and generic principles defined herein may be applied to other implementations. Thus, many changes and modifications may be made to the subject technology, by one having ordinary skill in the art, without departing from the scope of the subject technology. For instance, different numbers of a given module or unit may be employed, a different type or types of a given module or unit may be employed, a given module or unit may be added, or a given module or unit may be omitted.

Underlined and/or italicized headings and subheadings are used for convenience only, do not limit the subject technology, and are not referred to in connection with the interpretation of the description of the subject technology. All structural and functional equivalents to the elements of the various implementations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

What is claimed is:

1. An apparatus, comprising:

a reagent cartridge to be received within a cartridge receptacle of a system, the reagent cartridge comprising:

a plurality of reagent reservoirs;

a plurality of dedicated fluidic lines, each of the reagent reservoirs being coupled to a corresponding dedicated fluidic line;

a common fluidic line to be coupled to a flow cell and each of the dedicated fluidic lines;

a plurality of valves, each valve to control fluid flow between one of the dedicated fluidic lines and the common fluidic line;

a body including a surface forming depressions, each depression having a fluid inlet formed as an aperture through the surface, and a fluid outlet formed as an aperture through the surface and being fluidly coupled to at least one other depression; and a deformable material coupled to the surface of the body and including portions, each portion covering one of the depressions to define chambers, wherein the portions of the deformable material are movable relative to the depressions between a first position outside of a dimensional envelope of the body and a second position within the dimensional envelope of the body, wherein the surface of the body includes a mating surface to which the deformable material is coupled, a distance between the inlet and the mating surface is less than a distance between the outlet and the mating surface, wherein the chambers are coupled via a fluidic line having a first fluidic-line portion and a second fluidic-line portion, the first fluidic-line portion being coupled to the outlet of a first one of the chambers and extending from the outlet toward the mating surface and the second fluidic-line portion being coupled to the first fluidic-line portion and to the inlet of a second one of the chambers.

2. The apparatus of claim 1, further comprising the flow cell and wherein the reagent cartridge carries the flow cell and wherein the chambers are positioned downstream of the flow cell.

3. The apparatus of claim 1, further comprising the flow cell and wherein the reagent cartridge carries the flow cell and wherein the chambers are positioned upstream of the flow cell.

4. The apparatus of claim 1, wherein the inlets are vertically offset relative to respective ones of the outlets.

5. The apparatus of claim 1, wherein the depressions are concave and include apexes, the inlets being positioned adjacent the mating surface on a first side of the respective chambers and the outlets being positioned adjacent the apexes of the chambers on a second side of the respective chambers.

6. The apparatus of claim 1, wherein the deformable material includes a first surface and a second surface, the portions of the deformable material include first portions and second portions, the first surface of the deformable material including the first portions and the second portions, the second portions of the first surface coupled to the mating surface of the body, the first portions of the first surface and the second portions of the first surface being substantially coplanar.

7. The apparatus of claim 6, wherein the first surface and the second surface are substantially parallel relative to one another.

8. The apparatus of claim 1, wherein the deformable material includes concave portions that cover the respective depressions.

9. The apparatus of claim 8, wherein the concave portions comprise membrane switches.

10. The apparatus of claim 1, wherein the first fluidic portion extends from the outlet toward the mating surface at an oblique angle.

11. The apparatus of claim 1, further comprising the flow cell and wherein the reagent cartridge carries the flow cell and at least one chamber is positioned upstream of the flow cell and at least one chamber is positioned downstream of the flow cell.

12. The apparatus of claim 11, further comprising a plurality of chambers upstream of the flow cell along each of the dedicated fluidic lines and a plurality of chambers downstream of the flow cell.

13. The apparatus of claim 12, wherein the plurality of reagent reservoirs being fluidly connected to the chambers positioned upstream of the flow cell.

14. The apparatus of claim 13, further comprising a cache and the plurality of reagent reservoirs fluidly connected to the cache.

15. The apparatus of claim 14, wherein the cache is fluidly connected to the flow cell upstream of the flow cell.

16. The apparatus of claim 15, wherein the cache and the plurality of reagent reservoirs upstream of the flow cell are fluidically connected to the common fluidic line upstream of the flow cell.

17. An apparatus, comprising:

a system, including:

a cartridge receptacle having an opening;

a pump drive assembly; and a controller coupled to the pump drive assembly;

a fluidic cartridge receivable through the opening and within the cartridge receptacle and carrying a flow cell, the fluidic cartridge, comprising:

a reservoir;

chambers defined by a body of the fluidic cartridge, each chamber having a fluid inlet and a fluid outlet;

a deformable material covering the chambers; and fluidic lines that fluidly couple the reservoir, the flow cell, and the chambers, wherein the body includes a mating surface to which the deformable material is coupled, a distance between the inlet and the mating surface is less than a distance between the outlet and the mating surface, wherein at least one of the fluidic lines couples the chambers and comprises a first fluidic-line portion and a second fluidic-line portion, the first fluidic-line portion being coupled to the outlet of a first one of the chambers and extending from the outlet toward the mating surface and the second fluidic-line portion being coupled to the first fluidic-line portion at an angle to the first fluidic line portion and to the inlet of a second one of the chambers; and wherein the pump drive assembly, the chambers, and the deformable material form a linear peristaltic pump, and wherein the controller is adapted to cause the pump drive assembly to interface with the deformable material to cause the linear peristaltic pump to pump fluid through one or more of the fluidic lines.

18. The apparatus of claim 17, wherein the controller is adapted to cause the pump drive assembly to interface with the deformable material to cause the linear peristaltic pump to create a pulsatile flow of fluid through the one or more of the fluidic lines.

19. The apparatus of claim 17, wherein the controller is adapted to cause the pump drive assembly to interface with the deformable material covering a first one of the chambers but not to interface with the deformable material covering a second one of the chambers.

20. The apparatus of claim 17, wherein the pump drive assembly comprises a guide comprising guide bores, rods disposed within the respective guide bores, and an actuator adapted to selectively actuate the rods between a retracted position and an extended position, the rods comprising distal ends that are adapted to depress the deformable material of the linear peristaltic pump in the extended position.

21. The apparatus of claim 20, wherein the rods comprise cam followers, further comprising springs disposed within the respective ones of the guide bores to urge the cam followers toward the retracted position, and wherein the actuator comprises a cam shaft and a motor adapted to rotate the cam shaft, the cam shaft adapted to interface with the cam followers to actuate the cam followers.

22. An apparatus, comprising:

a body comprising a surface having a mating surface and defining chambers, adjacent chambers being fluidically coupled by a corresponding fluidic line, each chamber has an inlet and an outlet formed as apertures through the surface, each inlet being vertically offset relative to a corresponding outlet; and a deformable material coupled to the mating surface and covering the chambers, wherein a distance between the inlet and the mating surface is less than a distance between the outlet and the mating surface, and wherein the deformable material and the chambers form a linear peristaltic pump, wherein the deformable material covering each of the chambers is movable between a first position and a second position, in the first position, the deformable material sealingly engaging the inlet of a corresponding chamber, in the second position, the deformable material sealingly engaging the outlet of a corresponding chamber, and wherein the fluidic line comprises a first fluidic-line portion and a second fluidic-line portion, the first fluidic-line portion being coupled to the outlet of a first one of the chambers and extending from the outlet toward the mating surface and the second fluidic-line portion being coupled to the first fluidic-line portion and to the inlet of a second one of the chambers.

23. The apparatus of claim 22, wherein the chambers are responsive to an interface of a pump drive assembly with the deformable material.

24. The apparatus of claim 22, wherein the chambers are concave and include apexes, the inlets being positioned adjacent the mating surface on a first side of the respective chambers and the outlets being positioned adjacent the apexes of the chambers on a second side of the respective chambers.

25. An apparatus, comprising:

a reagent cartridge, comprising:

a plurality of reagent reservoirs;

a plurality of dedicated fluidic lines, each of the reagent reservoirs being coupled to a corresponding dedicated fluidic line;

a flow cell;

a common fluidic line coupled to the flow cell and each of the dedicated fluidic lines;

a plurality of valves, each valve to control fluid flow between one of the dedicated fluidic lines and the common fluidic line;

a body including a surface forming depressions along each of the dedicated fluidic lines, each depression having a fluid inlet formed as an aperture through the surface and a fluid outlet formed as an aperture through the surface and being fluidly coupled to at least one other depression; and a deformable material coupled to the surface of the body and including portions, each portion covering one of the depressions to define chambers, wherein the portions of the deformable material are movable relative to the depressions between a first position outside of a dimensional envelope of the body and a second position within the dimensional envelope of the body, wherein the surface of the body includes a mating surface to which the deformable material is coupled, a distance between the inlet and the mating surface is less than a distance between the outlet and the mating surface, wherein the chambers are coupled via a fluidic line having a first fluidic-line portion and a second fluidic-line portion, the first fluidic-line portion being coupled to the outlet of a first one of the chambers and extending from the outlet toward the mating surface and the second fluidic-line portion being coupled to the first fluidic-line portion and to the inlet of a second one of the chambers.

* * * * *